US009172187B2

(12) United States Patent
Miyakawa et al.

(10) Patent No.: US 9,172,187 B2
(45) Date of Patent: Oct. 27, 2015

(54) ELECTRICAL CONNECTOR

(71) Applicants: YAZAKI CORPORATION, Tokyo (JP); HONDA MOTOR CO., LTD., Tokyo (JP)

(72) Inventors: Tomoyuki Miyakawa, Utsunomiya (JP); Kazuto Ohtaka, Makinohara (JP); Hideki Homma, Tokyo (JP); Tetsuya Mitani, Tochigi (JP); Masaru Shinmura, Tochigi (JP); Masakazu Hira, Tochigi (JP); Kazuyuki Iwashita, Tochigi (JP); Toshinori Yamamoto, Makinohara (JP)

(73) Assignees: Yazaki Corporation, Tokyo (JP); Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 14/161,779

(22) Filed: Jan. 23, 2014

(65) Prior Publication Data

US 2014/0141637 A1 May 22, 2014

Related U.S. Application Data

(63) Continuation of application No. PCT/JP2012/069531, filed on Jul. 25, 2012.

(30) Foreign Application Priority Data

Jul. 25, 2011 (JP) ..... 2011-162466
Oct. 5, 2011 (JP) ..... 2011-221271
Oct. 5, 2011 (JP) ..... 2011-221272

(51) Int. Cl.
*H01R 13/64* (2006.01)
*H01R 13/629* (2006.01)
(Continued)

(52) U.S. Cl.
CPC ..... *H01R 13/64* (2013.01); *H01R 13/629* (2013.01); *H01R 13/639* (2013.01); *H01R 13/641* (2013.01); *H01R 13/7193* (2013.01); *H01R 13/7197* (2013.01)

(58) Field of Classification Search
CPC ..... H01R 13/6275; H01R 13/6272; H01R 13/6273
See application file for complete search history.

(56) References Cited

U.S. PATENT DOCUMENTS 4,915,642 A * 4/1990 Lin et al. ..... 439/352
4,954,097 A * 9/1990 Sekiguchi ..... 439/352
(Continued)

FOREIGN PATENT DOCUMENTS

CN 1312600 A 9/2001
CN 1441520 A 9/2003
(Continued)

OTHER PUBLICATIONS

Office Action dated Nov. 4, 2014, for corresponding Japanese Patent Application No. 2014-503891.
(Continued)

*Primary Examiner* — Gary Paumen
(74) *Attorney, Agent, or Firm* — Morgan, Lewis & Bockius LLP

(57) ABSTRACT

An electrical connector includes a housing body and a cover. The housing body includes a terminal accommodating hole that accommodates a terminal fitting, and a ferrite accommodating portion that accommodates a ferrite core. The cover covers the terminal fitting and the ferrite core attached to the housing body. The ferrite accommodating portion includes a ferrite accommodation chamber into which the ferrite core is inserted in a first direction perpendicular to a second direction in which the terminal fitting is inserted into the terminal accommodating hole, and protrusions provided on both inner side surfaces of the ferrite accommodation chamber facing in a third direction perpendicular to the first direction. The protrusions are engaged with concave portions formed on both side surfaces of the ferrite core to regulate movement of the ferrite core in the second direction.

6 Claims, 26 Drawing Sheets

(51) Int. Cl.

| | |
|---|---|
| ***H01R 13/639*** | (2006.01) |
| ***H01R 13/641*** | (2006.01) |
| ***H01R 13/7193*** | (2011.01) |
| ***H01R 13/7197*** | (2011.01) |

(56) References Cited

U.S. PATENT DOCUMENTS

| | | | | |
|---|---|---|---|---|
| 5,211,585 | A | 5/1993 | Douty et al. | |
| 5,658,159 | A | 8/1997 | Gardner et al. | |
| 5,718,596 | A * | 2/1998 | Inaba et al. | 439/352 |
| 5,769,555 | A | 6/1998 | Okada | |
| 5,827,086 | A * | 10/1998 | Fukuda | 439/357 |
| 6,036,223 | A | 3/2000 | Worrell et al. | |
| 6,074,235 | A * | 6/2000 | Brandberg et al. | 439/378 |
| 6,257,915 | B1 * | 7/2001 | Endo | 439/357 |
| 6,332,800 | B2 * | 12/2001 | Kodama | 439/357 |
| 6,533,600 | B1 * | 3/2003 | Kashiyama et al. | 439/352 |
| 6,688,907 | B2 * | 2/2004 | Yamaoka et al. | 439/489 |
| 7,470,132 | B2 * | 12/2008 | Perrin et al. | 439/188 |
| 8,449,313 | B2 * | 5/2013 | Suzuki et al. | 439/357 |
| 2001/0027043 | A1 | 10/2001 | Shiraki et al. | |
| 2002/0025708 | A1 | 2/2002 | Wakui et al. | |
| 2003/0162444 | A1 * | 8/2003 | Hayashi | 439/620 |
| 2004/0248454 | A1 | 12/2004 | Gunreben et al. | |
| 2005/0048843 | A1 | 3/2005 | Iida | |
| 2006/0154510 | A1 | 7/2006 | Annecke | |
| 2007/0264863 | A1 | 11/2007 | Nakamura | |
| 2008/0124966 | A1 * | 5/2008 | Lim | 439/357 |
| 2008/0194136 | A1 * | 8/2008 | Aihara | 439/378 |
| 2009/0023327 | A1 * | 1/2009 | Takahashi et al. | 439/357 |
| 2009/0111312 | A1 * | 4/2009 | Nakata et al. | 439/357 |
| 2009/0149054 | A1 * | 6/2009 | Zheng | 439/357 |
| 2010/0248525 | A1 * | 9/2010 | Shaojun | 439/357 |
| 2010/0279536 | A1 * | 11/2010 | Paulus | 439/357 |
| 2013/0164996 | A1 | 6/2013 | Miyakawa et al. | |

FOREIGN PATENT DOCUMENTS

| | | | |
|---|---|---|---|
| CN | 1610994 | A | 4/2005 |
| CN | 1666387 | A | 9/2005 |
| CN | 103081240 | A | 5/2013 |
| EP | 0 657 969 | A1 | 6/1995 |
| EP | 1 150 389 | A1 | 10/2001 |
| EP | 1 184 232 | A2 | 3/2002 |
| EP | 1 681 746 | A1 | 7/2006 |
| EP | 1 858 122 | A2 | 11/2007 |
| EP | 2 026 421 | A1 | 2/2009 |
| JP | 2002-151181 | A | 5/2002 |
| JP | 2003-203722 | A | 7/2003 |
| JP | 2005-044643 | A | 2/2005 |
| JP | 2005-190860 | A | 7/2005 |
| WO | 99/35011 | A1 | 7/1999 |
| WO | 2009/023200 | A2 | 2/2009 |

OTHER PUBLICATIONS

International Search Report dated Feb. 7, 2013 for International application No. PCT/JP2012/069531.

Office Action dated Jul. 31, 2015, issued by the Chinese Intellectual Property Office in corresponding Chinese Patent Application No. 201280036979.7.

* cited by examiner

ELECTRICAL CONNECTOR

CROSS REFERENCE TO RELATED APPLICATIONS

This application is a continuation of PCT application No. PCT/JP2012/069531, which was filed on Jul. 25, 2012 based on Japanese Patent Application No. 2011-162466 filed on Jul. 25, 2011, Japanese Patent Application No. 2011-221271 filed on Oct. 5, 2011, and Japanese Patent Application No. 2011-221272 filed on Oct. 5, 2011, the contents of which are incorporated herein by reference.

BACKGROUND OF THE INVENTION

1. Field of the Invention

The present disclosure relates to an electrical connector in which a ferrite core is provided in a housing body as a noise suppression part.

The present disclosure also relates to an electrical connector having a harness side connector and an accessory side connector to which the harness side connector is fitted, in which the accessory side connector is equipped with a jam prevention protrusion.

The present disclosure also relates to an electrical connector having a housing body on which a substantially cylindrical terminal holding portion and a spacer, separated by a predetermined distance to each other, are provided, and the terminal holding portion accommodating a terminal fitting and inserted into a fitting space of a counterpart connector, and the slider capable of sliding along the insertion direction into the fitting space of the terminal holding portion.

2. Description of the Related Art

FIG. 20 shows an example of the related art of ferrite embedded connectors. The ferrite embedded connector 1101 shown in FIG. 20 is disclosed in JP-A-2003-203722 and is used as an electrical connector of a vehicle-mounted air bag system.

The ferrite embedded connector 1101 includes a housing body 1110 and a cover 1120 attached to the housing body 1110 to cover an upper surface 1111 which is a side surface of the housing body 1110.

The housing body 1110 includes a terminal accommodating hole 1112 and a ferrite accommodating portion 1113.

The terminal accommodating hole 1112 has an opening 1112*b* at the upper surface 1111 of the housing body 1110. As shown by the arrow Y1 in FIG. 20, in the terminal accommodating hole 1112, a terminal fitting 1140 connected to an end portion of the electric wire 1130 is inserted from an opening 1112*b* of the upper surface 1111 of the housing body 1110 and mounted to the housing body 1110. The terminal accommodating hole 1112 is formed so as to pass through in a direction perpendicular to the upper surface 1111.

The ferrite accommodating portion 1113 is an accommodation space formed by being hollowed out of the upper surface 1111. The ferrite accommodating portion 1113 accommodates a ferrite core 1150 into which the electric wire 1130 connected to the terminal fitting 1140 is inserted.

The terminal fitting 1140 has a cylindrical fitting connection portion 1141 into which a counterpart male-type terminal fitting is fitted and an electric wire connection portion 1142 extended from the rear end of the fitting connection portion 1141. The terminal fitting 1140 is so-called L-type female terminal fitting in which the electric wire connection portion 1142 is extended in a direction intersects an extending direction of the fitting connection portion 1141. Further, at the outer surface of the fitting connection portion 1141, a retainer lance 1141*a* is provided. The lance 1141*a* is an elastic part which is dug out from a part of the side wall of the fitting connection portion 1141 and is inserted into a concave portion 1112*a* in the terminal accommodating hole 1112 to achieve retention in the terminal accommodating hole 1112.

The ferrite core 1150 is formed by a metal oxide ferromagnetic body. The ferrite core 1150 is provided on the electric wire 1130 as a noise suppression part preventing noise current due to various electromagnetic waves from the outside from flowing to the electric wire 1130.

The cover 1120 covers the terminal fitting 1140 mounted on the housing body 1110 and the top face of the ferrite core 1150

SUMMARY OF THE INVENTION

Here, in the ferrite embedded connector 1101 of JP-A-2003-203722 in which the retention of the terminal fitting 1140 is achieved by the lance 1141*a* provided in the fitting connection portion 1141, since it is necessary to secure the concave portion 1112*a* for engaging with the lance 1141*a*, the breadth of the opening 1112*b* of the terminal accommodating hole 1112 is increased in size. Thus, the increase in the size of the breadth caused inconvenience in terms of the increase in the size of the ferrite embedded connector 1101.

Further, the lance 1141*a* provided on the terminal fitting 1140 is easily damaged or deformed by interference of objects in the periphery during storage or transport before being embedded in the ferrite embedded connector 1101, and there is also a concern that the damage to or deformation of the lance 1141*a* may cause a deterioration in the assembly characteristic of the terminal fitting 1140 in the ferrite embedded connector 1101 or the retention performance of the terminal fitting 1140.

Further, in the ferrite embedded connector 1101 of JP-A-2003-203722, in order to reduce the size of the connector, it is effective to lower the profile by shrinking the length in the height direction (the direction of the arrow Y2 in FIG. 20) of the periphery of the ferrite accommodating portion 1113. However, regarding lowering the profile of the periphery of the ferrite accommodating portion 1113, there is a demand for the thinning of the inner lower wall 1113*a* of the ferrite accommodating portion 1113 dividing the ferrite accommodating portion 1113, or the thinning of part 1120*a* facing the ferrite accommodating portion 1113 of the cover 1120.

However, in the ferrite embedded connector 1101 of JP-A-2003-203722, since the part 1120*a* on the inner lower wall 1113*a* or the cover 1120 is set to a uniform thickness, there is a concern that, when thinning is performed, the fluidity of the resin at the time of injection molding would be deteriorated, and the formability may be deteriorated. Accordingly, there is a problem in that it is not possible to achieve a lowering of the profile by thinning the wall portion dividing the ferrite accommodation chamber.

Next, FIG. 21 shows an electrical connector disclosed in JP-A-2002-151181.

The electrical connector 2100 is used for supplying electricity to a squib (heating element) equipped in the inflator of a vehicle-mounted airbag system, and includes a harness side connector 2110 and an accessory (inflator) side connector 2120 to which the harness side connector 2110 is fitted, in which the accessory side connector 2120 is equipped with a jam prevention protrusion 2123.

The harness side connector 2100 includes a housing body 2111 accommodating the end portion of an electric wire 2131 of a wire harness, and a terminal holding portion 2112 protruded from the housing body 2111. The terminal holding portion 2112 accommodates a female terminal fitting (not shown) connected to an end portion of the electric wire inside the housing body 2111 and is inserted into a fitting space 2122*a* of a counterpart connector.

The accessory side connector 2120 includes a holder 2121, a fitting portion forming member (shunt ring) 2122, and a jam prevention protrusion 2123.

The holder 2121 is formed in a bottomed cylinder shape. In the center of the bottom portion 2121*a* of the holder 2121, a pair of pin terminals 2121*b*, in which a female terminal fitting is fitted, are provided. The pair of pin terminals 2121*b* are electricity supplying terminals of the squib (heating element) equipped in the inflator.

The fitting portion forming member 2122 is mounted in the holder 2121 such that the pin terminals 2121*b* pass therethrough and a fitting space 2122*a* in which the terminal holding portion 2112 is fitted is formed inside the holder 2121.

As shown in FIG. 22, the jam prevention protrusion 2123 is integrally formed with the leading edge of the fitting portion forming member 2112 so as to extend (stick out) along the fitting direction of the terminal holding portion 2112 to the fitting space 2122*a*. By increasing the sliding length between the terminal holding portion 2112 inserted into the fitting space 2122*a* and the fitting space 2122*a*, the jam prevention protrusion 2123 regulates the inclination of the terminal holding portion 2112 inserted into the fitting space 2122*a* during the fitting operation of the connectors and prevents the occurrence of jam.

In the case of the electrical connector 2100 of JP-A-2002-151181, as shown in FIG. 22, the leading edge of the jam prevention protrusion 2123 is set to a length protruding to the outside further than the leading edge surface of the holder 2121 by a length L1.

Here, in the harness side connector 2110 of JP-A-2002-151181, when the fitting of the connectors to each other is completed, the leading edge of the jam prevention protrusion 2123 comes into contact with the lower surface of the housing body 2111 as shown in FIG. 23.

In other words, when the assembly of the harness side connector 2110 with the accessory side connector 2120 is completed, the assembly height H2 of the harness side connector 2110 protruding from the leading edge surface of the holder 2121 becomes a value in which the protrusion length L1 from the holder 2121 of the jam prevention protrusion 2123 is added to the height dimension H1 of the housing body 2111, and thereby causing an increase in the assembly height H2.

In vehicles, there is a high demand for space reduction regarding the part in which the inflator of an airbag system is equipped and profile lowering in which the assembly height is reduced in the connector equipped in the inflator has become a significant problem.

Also, FIG. 24 shows an electrical connector 3100 disclosed in JP-A-2002-151181.

The connector 3100 is used to supply electricity to a squib (heating element) equipped in an inflator of a vehicle-mounted airbag system and includes a first connector 3110 connected to the leading edge of the wire harness, and an inflator side connector 3120 to which the connector 3110 is fitted.

The harness side connector 3100 includes a housing body 3111 accommodating the end portion of an electric wire 3131 of a wire harness, and a terminal holding portion 3112 protruded from the housing body 3111. The terminal holding portion 3112 accommodates a female terminal fitting (not shown) connected to an end portion of the electric wire inside the housing body 3111 and is inserted into a fitting space 3122*a* of a counterpart connector.

The accessory side connector 3120 includes a holder 3121, a fitting portion forming member (shunt ring) 3122, and a jam prevention protrusion 3123.

The holder 3121 is formed in a bottomed cylinder shape. In the center of the bottom portion 3121*a* of the holder 3121, a pair of pin terminals 3121*b*, in which a female terminal fitting is fitted, are provided. The pair of pin terminals 3121*b* are electricity supplying terminals of the squib (heating element) equipped in the inflator.

The fitting portion forming member 3122 is mounted in the holder 3121 such that the pin terminals 3121*b* pass therethrough and a fitting space 3122*a* in which the terminal holding portion 3112 is fitted is formed inside the holder 3121.

As shown in FIG. 24, in the connector 3110, a slider 3113 capable of sliding along the insertion direction toward a fitting space 3122*a* of the terminal holding portion 3112 is held by and built into the terminal holding portion 3112. The slider 3113 is used to detect the incomplete fitting of the connectors to each other or to lock the state in which the connectors are linked to each other.

Here, there have been problems in that the structure of the terminal holding portion 3112 having the built-in slider 3113 is increasingly complicated to form a structure to hold the slider 3113 and the assembly process is increasingly complicated.

Here, in order to solve the above-described problem, the applicant has developed the connector 3200 shown in FIG. 25.

In the connector 3200, a substantially cylindrical terminal holding portion 3210 accommodating a terminal fitting and inserted into a fitting space of a counterpart connector and a slider 3220 capable of sliding along the insertion direction (the direction of the arrow X1 in FIG. 25) to the fitting space of the terminal holding portion 3210 are separated by a predetermined distance D1 and arranged on a housing body 3230.

In this manner, by arranging the slider 3220 outside the terminal holding portion 3210, it is possible to simplify the structure of the terminal holding portion 3210 and it is possible to facilitate the assembly of the connector 3200.

In the case of the connector 3200 shown in FIG. 25, the slider 3220 includes a base portion 3221 slidably moving inside a slider accommodating portion 3231 formed in the housing body 3230, a first retaining protrusion 3223 provided at a first position P1 closest to the terminal holding portion 3210 at the periphery of the base portion 3221, and a second retaining protrusion 3224 provided at a second position P2 positioned at the opposite side to the first position P1 with the base portion 3221 interposed therebetween, at the periphery of the base portion 3221. The equipping positions of the first retaining protrusion 3223 and the second retaining protrusion 3224 are matched with respect to the axis direction.

Meanwhile, the slider accommodating portion 3231 includes a position aligning surface 3231*a* at the leading side in the sliding direction with respect to the first retaining protrusion 3223 and the second retaining protrusion 3224.

As shown in FIG. 25, the position aligning surface 3231*a* regulates the movement of the slider 3220 in the protruding direction by coming into contact with the two retaining protrusions 3223 and 3224.

The slider 3220 accommodated in the slider accommodating portion 3231 is urged in the protruding direction by a compressed coil spring 3240 arranged inside the slider accommodating portion 3231.

Here, when the slider 3220 is positionally aligned by the pressing of the two retaining protrusions 3223 and 3224 on the position aligning surface 3231*a* in the connector 3200 shown in FIG. 25, as shown by the arrow M1 in FIG. 26, there are times when the leading edge side of the slider 3220 is put into a state of being obliquely positionally aligned in the direction separating from the terminal holding portion 3210 due to forming errors or the like of the respective retaining protrusions 3223 and 3224 in the slider 3220 or forming errors or the like of the position aligning surface 3231*a*. In such a state of positional alignment, the separation dimension D2 between the leading edge portion of the slider 3220 and the terminal holding portion 3210 becomes greater than the originally estimated separation dimension D1, and the electric wire 3300 located in the periphery at the keeping locations or the like easily enters the gap 3250 between the slider 3220 and the terminal holding portion 3210.

Therefore, during keeping or the like or during transport or the like, there is a concern that a problem in which the electric wire 3300 becomes wedged in the gap 3250 between the slider 3220 and the terminal holding portion 3210 would occur.

Here, in order to solve the first problem, an object of the present disclosure is to provide an electrical connector which realizes retention of the terminal fitting without providing a lance at the terminal fitting and can reduce the size of the breadth of the part accommodating the terminal fitting of the housing body. In addition, an object of the invention is to provide an electrical connector which reduces the height dimension of the ferrite accommodation chamber periphery by thinning the wall portion dividing the ferrite accommodation chamber accommodating the ferrite core, and which can lower the profile of the connector.

Also, in order to solve the second problem, an object of the present disclosure is to provide an electrical connector capable of achieving a lowering of the profile, in which the jam prevention protrusion equipped in the accessory side connector in order to prevent the jam does not incur an increase in the assembly height of the connector when the connectors are fitted to each other.

In order to solve the third problem, an object of the invention is to provide an electrical connector capable of preventing a problem in which the electric wire is wedged in the gap between the substantially cylindrical terminal holding portion protruding from the housing body and the slider during keeping or during transport or the like.

The above described objects of the present disclosure are achieved by the following configurations.

(1) There is provided an electrical connector comprising:

a first connector that accommodates a female terminal fitting connected to an end portion of an electric wire of a wire harness; and a second connector that is fitted with the first connector, wherein the first connector includes:

a housing body; and a terminal holding portion which is formed so as to be protruded from the housing body and is inserted into a fitting portion of the second connector;

wherein the second connector includes:

a holder having a male terminal to which the female terminal fitting is fitted;

a fitting portion forming member which forms the fitting portion inside the holder when the fitting portion forming member is attached to the holder so that the male terminal is passed through the holder;

a jam prevention protrusion which is integrally formed with the fitting portion forming member and extends along an insertion direction of the terminal holding portion into the fitting space to regulate inclination of the terminal holding portion during an operation of fitting the first and second connectors to each other;

wherein a leading edge portion of the jam prevention protrusion is set to a length protruding outside further than a leading edge surface of the holder;

wherein a protrusion accommodating portion is formed in the housing body which is continuous to a base end of the terminal holding portion; and wherein the protrusion accommodating portion accommodates the leading edge portion of the jam prevention protrusion so that a leading edge surface of the housing body comes into contact with the leading edge surface of the holder.

(2) For example, the first connector is a ferrite embedded connector which accommodates a ferrite core attached to an electric wire connected to the female terminal fitting; and wherein the second connector is a connector for a squib equipped in an inflator of a vehicle-mounted airbag system.

(3) There is also provided an electrical connector comprising:

a housing body; and a cover attached to the housing body so as to cover an opening formed in a surface of the housing body, wherein the housing body includes:

a terminal accommodating hole that accommodates a terminal fitting connected to an end portion of an electric wire; and a ferrite accommodating portion that accommodates a ferrite core attached to the electric wire;

wherein the cover covers the terminal fitting and the ferrite core attached to the housing body;

wherein the ferrite accommodating portion includes:

a ferrite accommodation chamber into which the ferrite core is inserted in a first direction perpendicular to a second direction in which the terminal fitting is inserted into the terminal accommodating hole; and protrusions provided on both inner side surfaces of the ferrite accommodation chamber facing in a third direction perpendicular to the first direction; and wherein the protrusions are engaged with concave portions formed on both side surfaces of the ferrite core to regulate movement of the ferrite core in the second direction.

(4) For example, the protrusions are ribs which extend along the first direction on the both inner side surfaces of the ferrite accommodating chamber, and the concave portions are engagement grooves formed on the both side surfaces of the ferrite core so that the ferrite core is slidable along the first direction with respect to the ferrite accommodation chamber.

(5) For example, thickness increasing ribs extending along the first direction are provided on an inner surface of the cover and an inner lower surface of the ferrite accommodation chamber which face surfaces of the ferrite core in the second direction; and wherein rib receiving grooves for receiving the thickness increasing ribs are formed on the surfaces of the ferrite core facing the inner surface of the cover and the inner lower surface of the ferrite accommodation chamber.

(6) There is also provided an electrical connector comprising:

a housing body;

a terminal holding portion that accommodates a terminal fitting and is inserted into a fitting portion of a counterpart connector; and a slider that slides along an insertion direction in which the terminal holding portion inserts into the fitting portion, wherein the terminal holding portion and the slider are separated by a predetermined distance and are provided on the housing body;

wherein, in a state where the terminal holding portion is not inserted into the counterpart connector, the slider is supported by a slider accommodating portion of the housing body in an inclined condition that a gap between the slider and the terminal holding portion gradually becomes narrow toward a leading edge portion of the slider; and wherein in the inclined condition of the slider, a separation distance between the leading edge portion of the slider and the terminal holding portion is smaller than a standard separation distance necessary during a regular sliding operation of the slider.

(7) For example, the slider includes a base portion which slidably moves inside the slider accommodating portion, a first retaining protrusion provided at a first position closest to the terminal holding portion at a periphery of the base portion, and a second retaining protrusion which is provided at a second position which is at the opposite side to the first position so that the base portion is arranged between the first position and the second position at the periphery of the base portion and is deviated in the insertion direction of the terminal holding portion from the first retaining protrusion, the slider accommodating portion has a position aligning surface which is arranged between the leading edge portion of the slider and both of the first retaining protrusion and the second retaining protrusion and which regulates movement of the slider in a protruding direction of the leading edge portion of the slider by being contacted with the first and second retaining protrusions, and in the inclined condition of the slider, both the first retaining protrusion and the second retaining protrusion come into contact with the position aligning surface.

According to the electrical connector of the present disclosure, the load in the direction along the insertion direction of the terminal fitting acting on the electric wire from outside is absorbed by regulating the movement of the ferrite core using the engagement of the vertical movement prevention protrusion provided in both inner side surfaces facing the ferrite accommodation chamber and the protrusion engagement concave portion of both side surfaces of the ferrite core and is not transmitted to the terminal fitting accommodated in the housing body.

Therefore, it is possible to realize retention of the terminal fitting even without providing a lance in the terminal fitting. Accordingly, the terminal fitting accommodated in the housing body is given a slim exterior in which the lance is left out and it is possible to set a slim structure which does not have a terminal accommodating hole of the housing body or a concave portion which is an engagement location of the lance, and, by slimming the terminal fitting and the terminal accommodating hole, it is possible to reduce the size of the breadth of the part accommodating the terminal fitting of the housing body in comparison with the housing body of the related art in which the lance of the terminal fitting was used for retention.

Accordingly, it is possible to avoid the inconvenience of the increasing of the size of the connector caused by increasing the size of the breadth of the part accommodating the terminal fitting of the housing body.

Further, since there is no longer a need to equip a retaining lance in the terminal fitting, it is possible to avoid damage to or deformation of the terminal fitting caused by interference of the lance. Therefore, for example, it is possible to avoid the occurrence of the problem of the deterioration of the assembly characteristic of the terminal fitting in the ferrite embedded connector or the deterioration of the retention performance of the terminal fitting, that is, the problems caused by the damage to or deformation of the terminal fitting.

According to the electrical connector according to the present disclosure, when the assembly of the harness side connector with the accessory side connector is completed, the leading edge portion of the jam prevention protrusion protruding from the leading edge surface of the holder is accommodated in a protrusion accommodating portion provided in the housing main body of the harness side connector. Therefore, it is possible to obtain an assembly state in which the housing main body of the first connector is in direct contact with the surface of the holder.

That is, the assembly height of the first connector protruding from the leading edge surface of the holder matches the height dimension of the housing body and the jam prevention protrusion does not cause an increase in the assembly height.

Accordingly, the jam prevention protrusion provided in the second connector for preventing jam when the first and second connectors are fitted to each other can achieve a lowering of the profile without causing an increase in the assembly height of the first and second connectors.

According to the connector according to the present disclosure, in the initial state in which the counterpart connector is not connected, the slider is maintained in an inclined state where the separation distance between the leading edge portion of the slider and the terminal holding portion is smaller than a standard separation distance necessary during a regular sliding operation.

Therefore, even when performing positional alignment in which the leading edge side of the slider is inclined in a direction separating from the terminal holding portion due to forming errors or the like, it is possible to keep the separation distance between the leading edge of the slider and the terminal holding portion in a range that does not exceed the standard separation distance necessary during a regular sliding operation.

Accordingly, if the standard separation distance necessary during a regular sliding operation is set to the outer diameter or less of the electric wire for which there is a possibility of contact with the connector during keeping or during transport, it is possible to prevent accidents in which the electric wire or the like becomes wedged in the gap between the terminal holding portion and the slider.

BRIEF DESCRIPTION OF THE DRAWINGS

FIG. 5A is a longitudinal sectional view showing a state of the initial period of the fitting, FIG. 5B is a longitudinal sectional view showing a state during the fitting, and FIG. 5C is a longitudinal sectional view showing a state where fitting is completed;

DETAILED DESCRIPTION OF THE EXEMPLARY EMBODIMENTS

Below, detailed description will be given of favorable embodiments of the ferrite embedded connector of the present disclosure with reference to the drawings.

Figure 1:
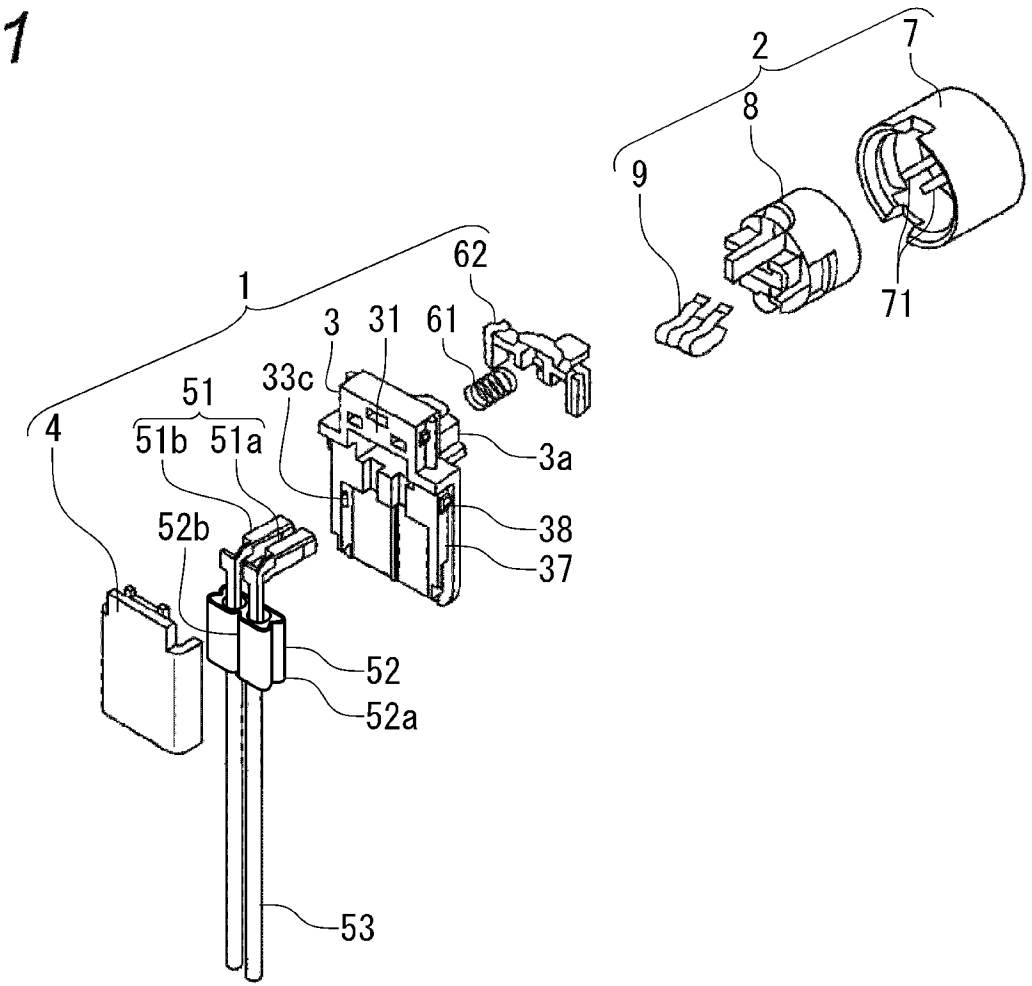
FIG. 1 is an exploded perspective view of a ferrite embedded connector according to a first embodiment of the present disclosure.
Figure 2A:
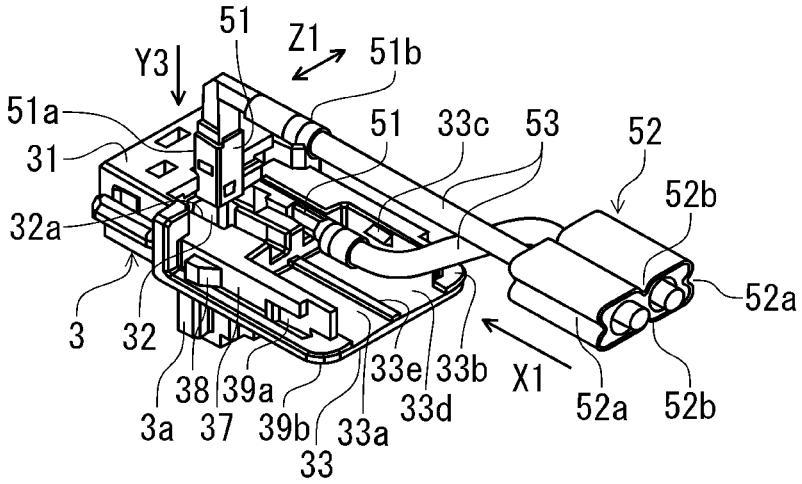
FIG. 2A is an explanatory view of steps of inserting and mounting the terminal fitting shown in FIG. 1 in the terminal accommodating hole of the housing body.
Figure 2B:
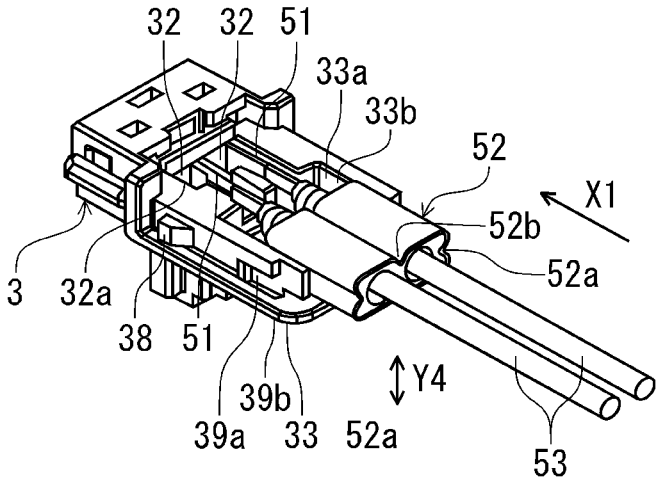
FIG. 2B is an explanatory view of steps of inserting and mounting the ferrite core shown in FIG. 1 in the ferrite accommodating portion of the housing body.
Figure 3:
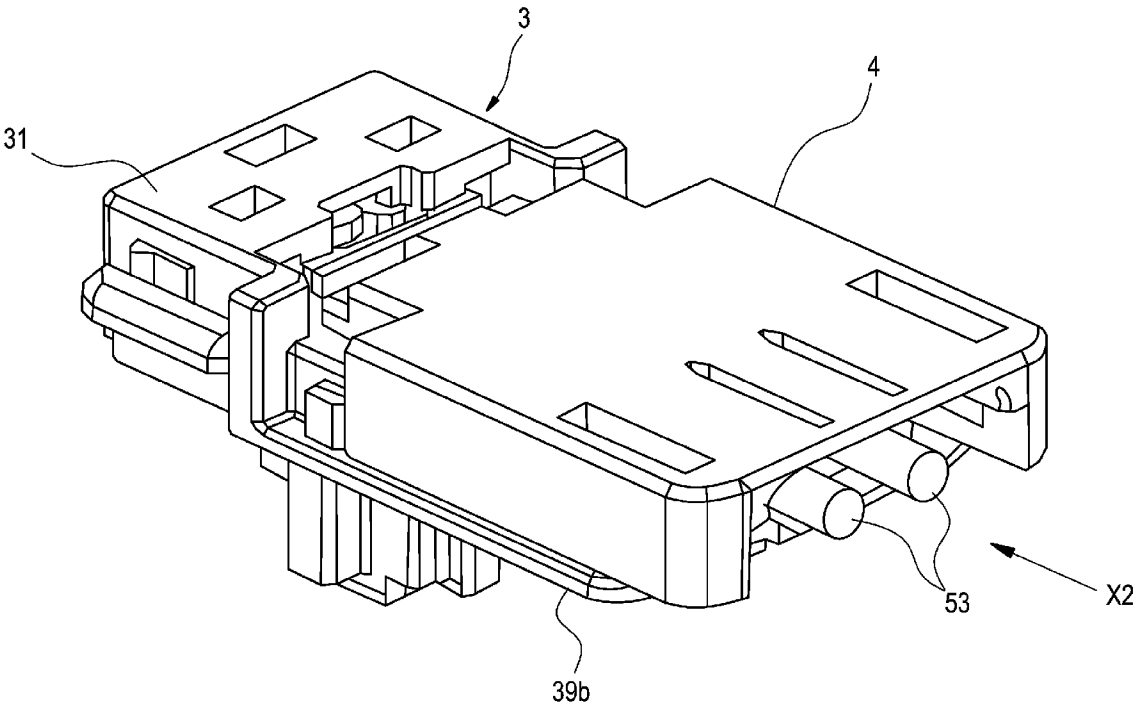
FIG. 3 is a perspective view showing the attachment structure of the cover to the housing body shown in FIG. 1.
Figure 4:
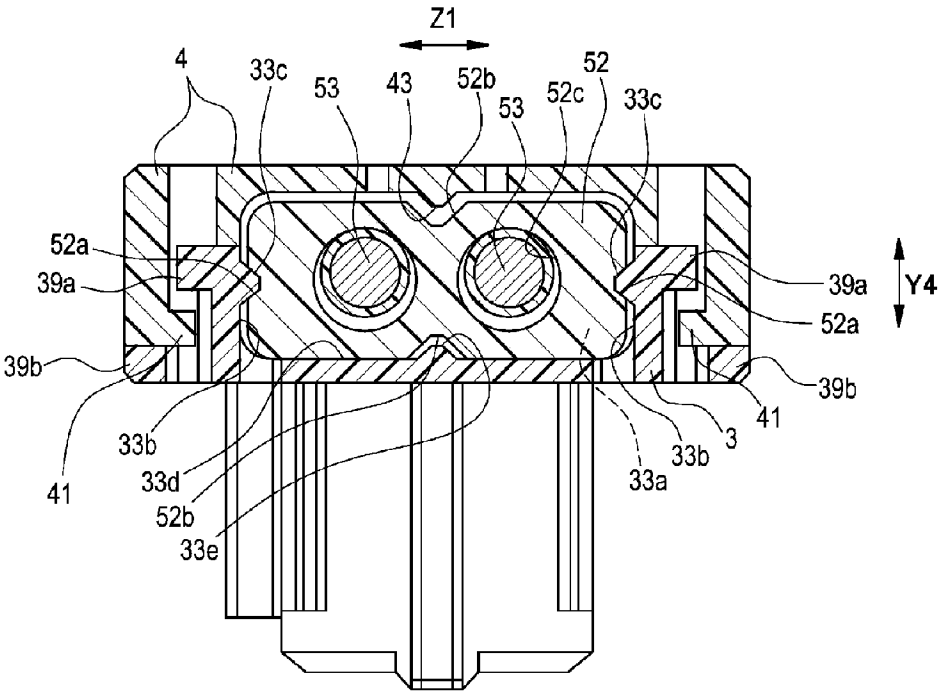
FIG. 4 is a transversal sectional view showing a support structure of the ferrite core in the ferrite embedded connector of one embodiment in which assembly has been completed.
Figure 5A:
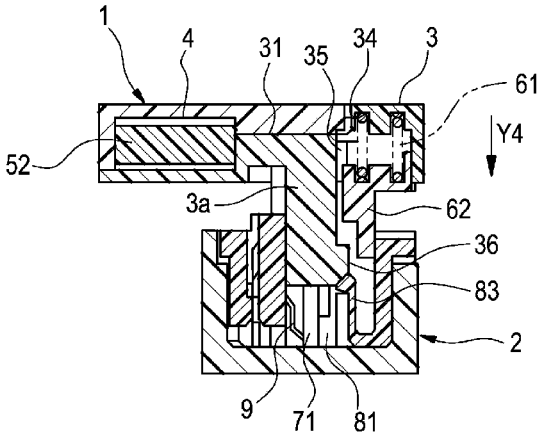
FIGS. 5A to 5C are explanatory views of steps of fitting and connecting the ferrite embedded connector (plug) shown in FIG. 4 to the connector (socket) of the connection counterpart.
Figure 5B:
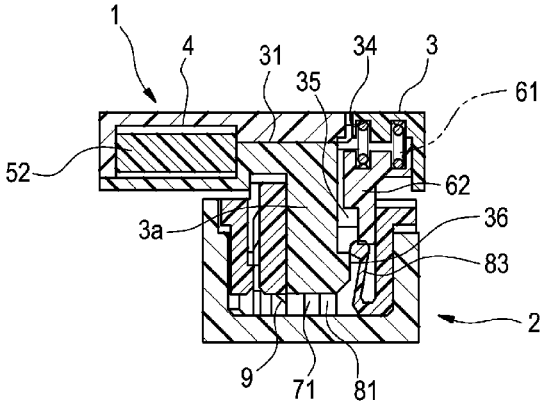
Figure 5C:
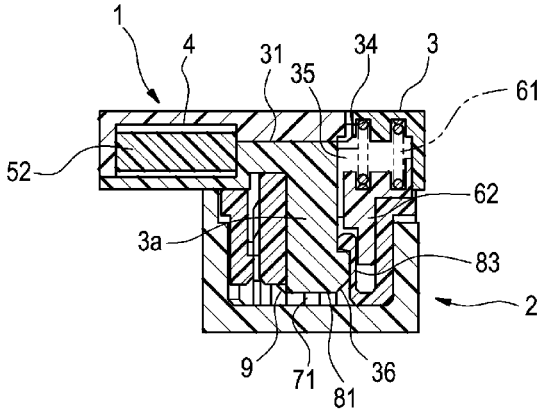

FIGS. 1 to 5 are explanatory diagrams of an electrical connector according to a first embodiment of the present disclosure, FIG. 1 is an exploded perspective view of a ferrite embedded connector according to the first embodiment, FIG. 2A is an explanatory view of steps of inserting and mounting the terminal fitting shown in FIG. 1 in the terminal accommodating hole of the housing body, FIG. 2B is an explanatory view of steps of inserting and mounting the ferrite core shown in FIG. 1 in the ferrite accommodating portion of the housing body, FIG. 3 is a perspective view showing the attachment structure of the cover to the housing body shown in FIG. 1, FIG. 4 is a transversal sectional view showing a support structure of the ferrite core in the ferrite embedded connector of one embodiment in which assembly has been completed, FIG. 5 are explanatory views of steps of fitting and connecting the ferrite embedded connector (plug) shown in FIG. 4 to the connector (socket) of the connection counterpart, FIG. 5A is a longitudinal sectional view showing a state of the initial period of the fitting, FIG. 5B is a longitudinal sectional view showing a state during the fitting, and FIG. 5C is a longitudinal sectional view showing a state where fitting is completed.

The ferrite embedded connector 1 of the first embodiment is, for example, a plug in an electrical connector of a vehicle-mounted airbag system. The connector 1 is fitted to a connector 2 shown in FIG. 1. The connector 2 is a socket in the electrical connector of the airbag system.

As shown in FIG. 1, the connector 1 includes a housing body 3, a cover 4 attached to the housing body 3 in order to cover one side surface 31 of the housing body 3, a terminal fitting 51 and ferrite core 52 attached to the housing body 3 from the one side surface 31 side, a coil spring 61 mounted on the housing body 3 from a side surface of the opposite side to the one side surface 31 of the housing body 3, and a slider 62.

As shown in FIGS. 2A to 5, the housing body 3 includes a terminal insertion hole 32, a ferrite accommodating portion 33, a spring holding portion 34, a slider accommodating portion 35, and a locking protrusion 36.

As shown in FIG. 1 and FIGS. 2A and 2B, the terminal insertion hole 32 is a hole in which the fitting connection portion 51*a* of the terminal fitting 51 connected to the end portion of the electric wire 53 is inserted and mounted.

Figure 20:
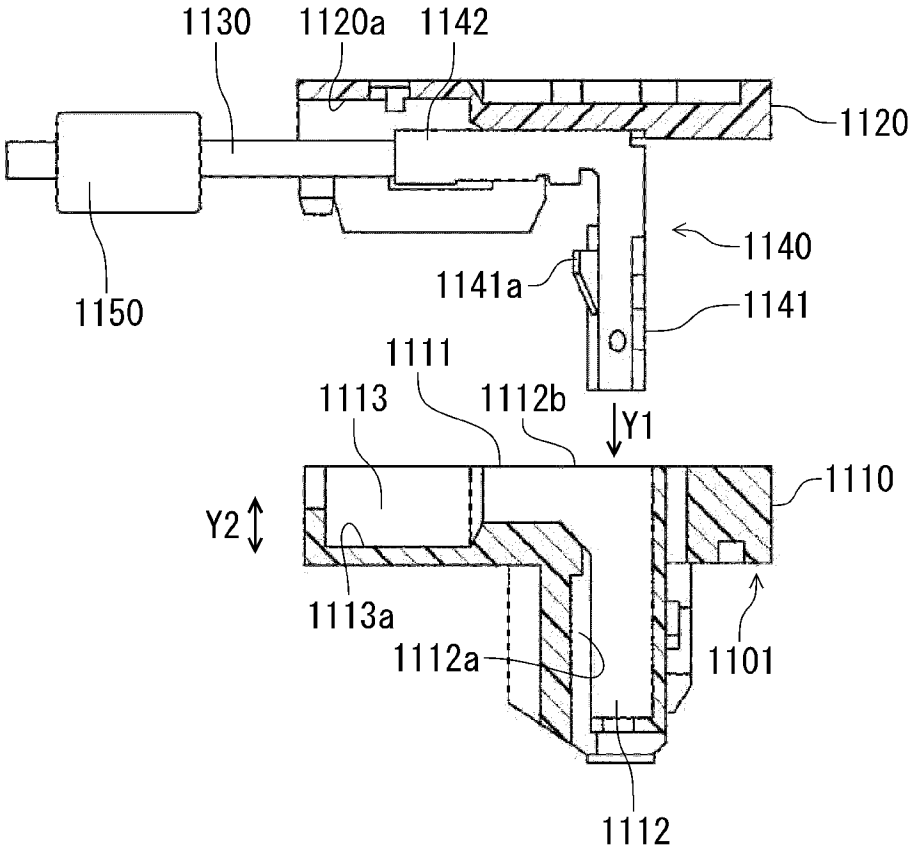
FIG. 20 is an exploded longitudinal sectional view of the ferrite embedded connector of the related art.
Figure 21:
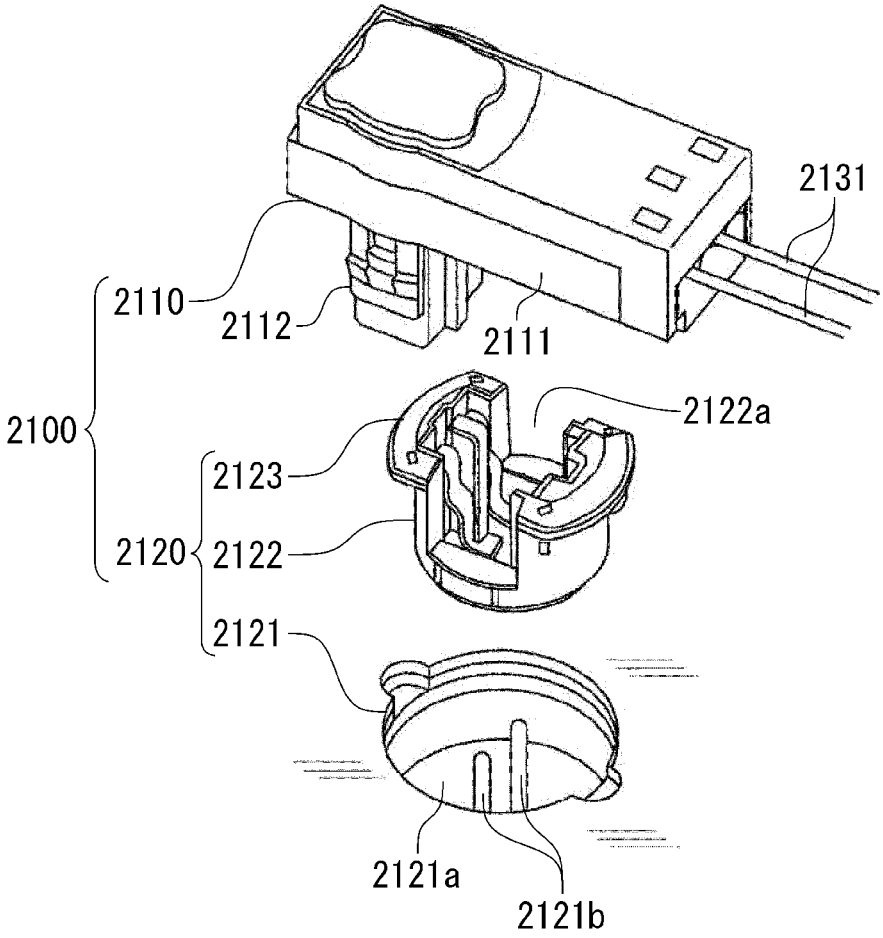
FIG. 21 is an exploded perspective view of an electrical connector of the related art.
Figure 22:
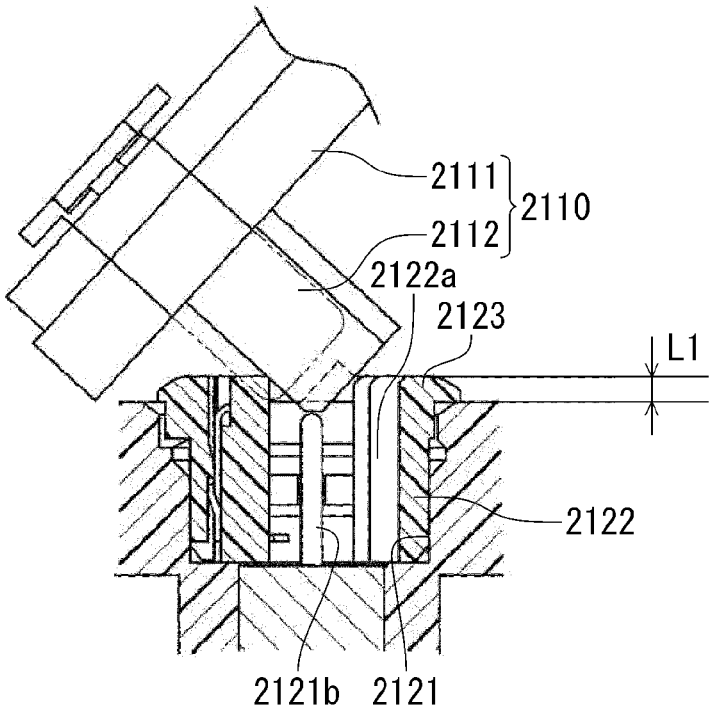
FIG. 22 is an explanatory diagram of a state where the harness side connector is inclined when the fitting of the connectors shown in FIG. 21 to each other is started.
Figure 23:
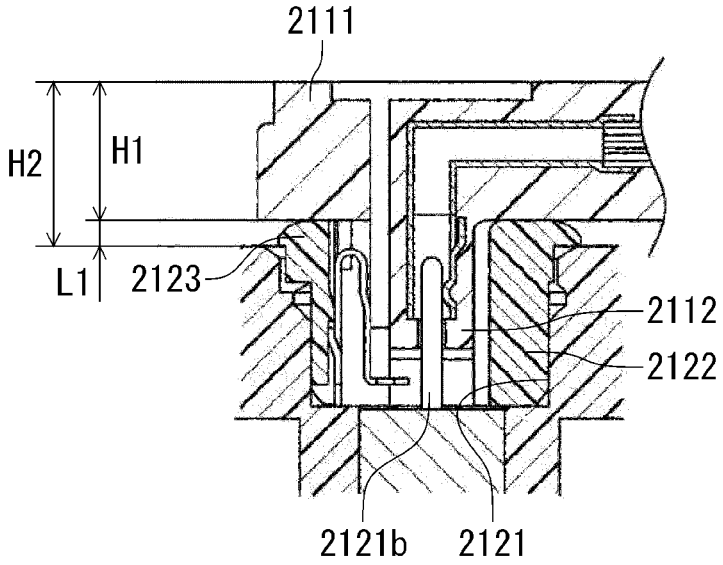
FIG. 23 is a cross-sectional view of a state where the fitting of the connectors shown in FIG. 21 to each other is completed.
Figure 24:
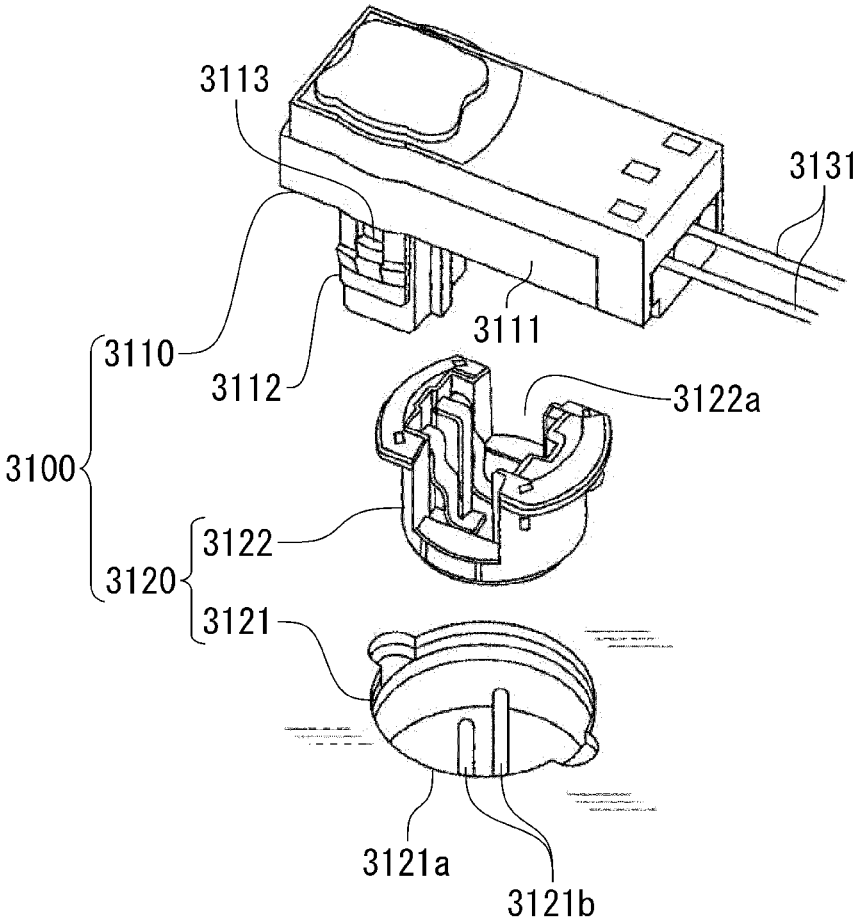
FIG. 24 is a perspective view of a connector of the related art.
Figure 25:
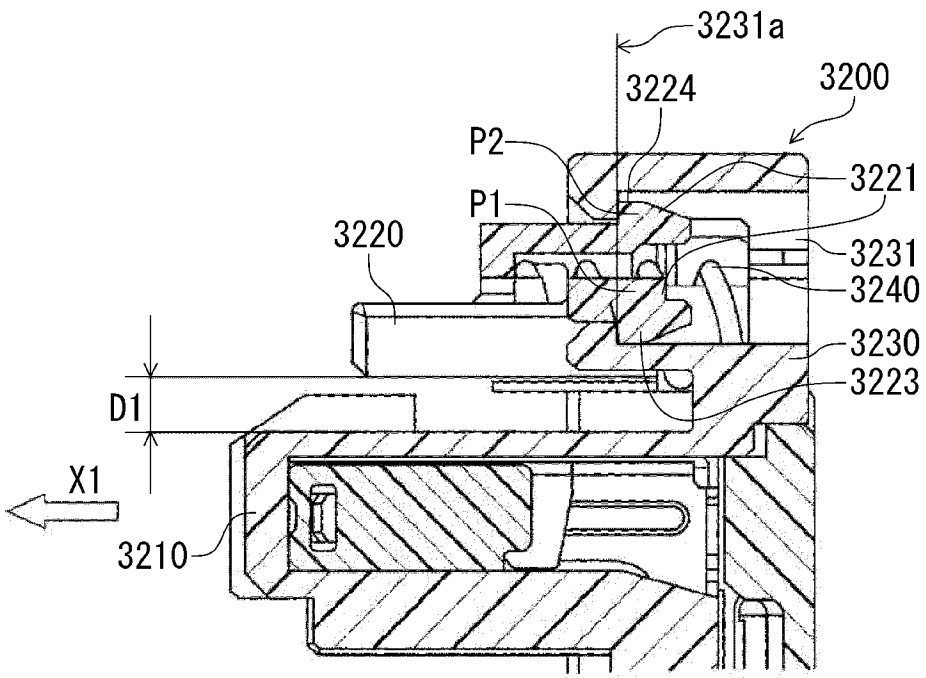
FIG. 25 is a longitudinal sectional view of the main parts of a connector in which the problematic points in the connector shown in FIG. 24 have been improved.
Figure 26:
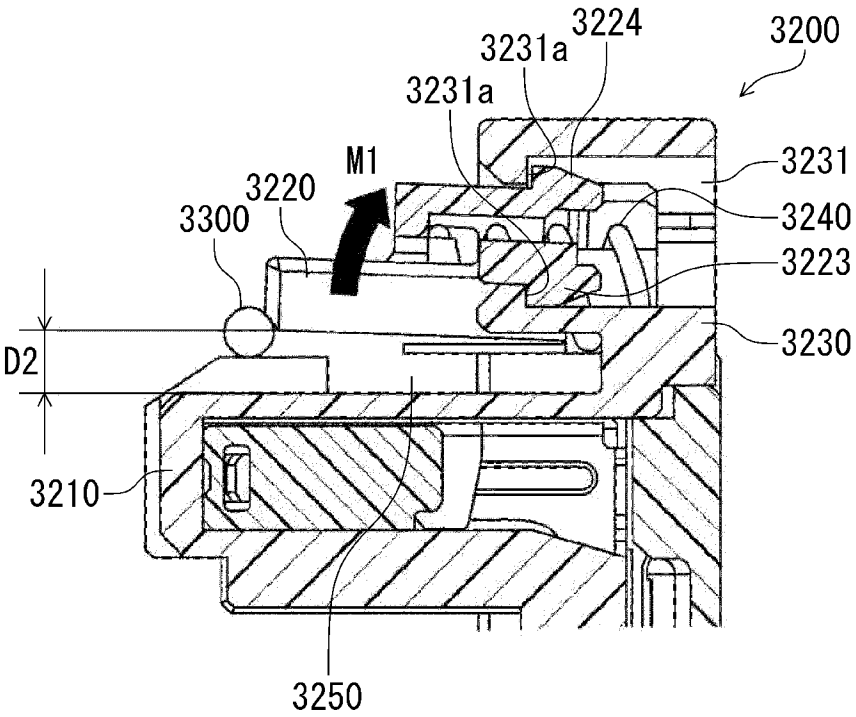
FIG. 26 is an explanatory diagram of the problematic points in the connector shown in FIG. 25.

As shown in FIG. 1 and FIGS. 2A and 2B, the terminal fitting 51 has a fitting connection portion 51*a* with a square tube shape in which the male terminal fitting equipped at the connector 2 is fitted, and an electric wire connection portion 51*b* extending from the rear end of the fitting connection portion 51*a*. The terminal fitting 51 is so-called a L-type female terminal fitting and the electric wire connection portion 51*b* is extended in a direction perpendicular to an extending direction of the fitting connection portion 51*a*. Further, the fitting connection portion 51*a* has a simple square tube structure in which a retention lance (refer to FIG. 20) is not equipped, and thus the fitting connection portion 51*a* is slimmed by a degree without having a lance in comparison with the fitting connection portion 141 of FIG. 20.

The terminal insertion hole 32 is formed to pass through the housing body 3 along a direction (the direction of the arrow Y3 in FIG. 2) perpendicular to the one side surface 31 of the housing body 3. As shown by arrow Y3 in FIG. 2A, in the terminal insertion hole 32, the terminal fitting 51 is inserted from the opening edge 32*a* of the one side surface 31 and mounted.

The ferrite accommodating portion 33 is a part accommodating the ferrite core 52 through which the electric wire 53 connected to the terminal fitting 51 is inserted.

The ferrite core 52 is formed in a block shape by a metal oxide ferromagnetic body. In the ferrite core 52, an electric wire insertion opening 52*c* (refer to FIG. 4) into which the electric wire 53 is inserted is formed so as to pass therethrough. The ferrite core 52 is provided on the electric wire 53 as a noise suppression part preventing noise current due to various electromagnetic waves from the outside from flowing to the electric wire 53.

Engagement grooves 52*a* and rib receiving grooves 52*b* are formed on the outer side surfaces of the ferrite core 52 of this embodiment.

As shown in FIGS. 2A, 2B and 4, the engagement grooves 52*a* are protrusion engagement concave portions with which vertical movement prevention ribs (ribs) 33*c* are engaged as vertical movement prevention protrusions (protrusions) of the ferrite accommodating portion 33 to be described later and are formed on both side surfaces facing the width direction of the ferrite core 52. The engagement grooves 52*a* are grooves with a substantially V-shaped cross-section extending along the insertion direction (the direction of the arrow X1 in FIG. 2A) of the ferrite core 52 into the ferrite accommodating portion 33, and the vertical movement prevention ribs 33*c* to be described later are engaged with the engagement grooves 52*a* in slidable manner along the insertion direction of the ferrite core 52. When the ferrite core 52 is mounted in the ferrite accommodating portion 33, by engaging the vertical movement prevention ribs 33*c* to be described later with the engagement grooves 52*a*, the movement of the ferrite core 52 in the direction along the insertion direction of the terminal fitting 51 is regulated.

Each of the rib receiving grooves 52*b* has a V-shaped cross-section extending along the insertion direction (the direction of the arrow X1 in FIG. 2A) of the ferrite core 52 into the ferrite accommodating portion 33. The rib receiving grooves 52*b* are formed on the upper and lower surfaces of the ferrite core 52 facing the inner surface of the cover 4 and the inner lower surface of the ferrite accommodation chamber 33*a*. The respective rib receiving grooves 52*b* receive the thickness increasing ribs 33*e* and 43 provided on the cover 4 to be described later and the inner lower surface of the ferrite accommodating portion 33.

In the case of the housing body 3 of this embodiment, the ferrite accommodating portion 33 is formed by being hollowed out of the one side surface 31 of the housing body 3. To give description in more detail, as shown in FIGS. 2A, 2B and 4, the ferrite accommodating portion 33 is a structure in which the vertical movement prevention ribs 33*c* are provided on a pair of facing inner side surfaces 33*b* of the ferrite accommodation chamber 33*a* in which the ferrite core 52 is inserted and mounted.

The ferrite accommodation chamber 33*a* has a space in which the ferrite core 52 is inserted in a direction (direction of the arrow X1 of FIG. 2B) perpendicular to the insertion direction (direction of the arrow Y3 of FIG. 2A) of the terminal fitting 51 with respect to the terminal insertion hole 32.

As shown in FIG. 2A, the pair of inner side surfaces 33*b* in the ferrite accommodation chamber 33*a* are inner side surfaces facing the housing width direction (direction of the arrow Z1 of FIG. 2A and FIG. 4) perpendicular to the insertion direction (direction of the arrow X1 of FIG. 2B) of the ferrite core 52.

As shown in FIG. 2A and FIG. 4, the vertical movement prevention ribs 33*c* are vertical movement prevention protrusions provided on the respective inner side surfaces 33*b*. The vertical movement prevention protrusions 33*c* are formed in a rib structure by being extended in the insertion direction of the ferrite core 52.

Further, a thickness increasing rib 33*e* is provided on the inner lower surface 33*d* of the ferrite accommodation chamber 33*a*. The thickness increasing rib 33*e* is a rib extending along the insertion direction of the ferrite core 52 as shown in FIG. 2, and is received in the rib receiving groove 52*b* of the ferrite core 52 provided on the ferrite accommodation chamber 33*a* as shown in FIG. 4.

As shown in FIGS. 2A and 2B, cover locking protrusions 38 for locking the cover 4 are provided on both outer surfaces 37 facing the housing width direction of the housing body 3.

The spring holding portion 34 holds the coil spring 61 shown in FIG. 1. As shown in FIG. 5, the spring holding portion 34 is equipped at the side surface of the opposite side to the one side surface 31 of the housing body 3, that is, the side facing the connector 2. The spring holding portion 34 holds the coil spring 61 using a circular groove into which one edge side of the coil spring 61 is fitted.

The coil spring 61 mounted on the spring holding portion 34 biases a slider 62 to be described later to the connector 2 side (in the direction of fitting the connector 1 to the connector 2, the direction of the arrow Y4 in FIG. 5A).

A slider accommodating portion 35 is a part accommodating the slider 62 shown in FIG. 1 and the slider 62 covering the top of the coil spring 61 of the spring holding portion 34 is accommodated so as to be capable of sliding movement to the connector 2.

As shown in FIG. 5B and FIG. 5C, when the fitting of the connector 1 and the connector 2 is completed as normal and a lock piece 83 equipped on the connector 2 side is engaged with the locking protrusion 36 of the housing body 3, the slider 62 enters the rear portion of the lock piece 83 by the biasing force due to the coil spring 61 and regulates the movement in the engagement release direction of the lock piece 83. That is, the slider 62 functions as two-fold locking means for locking the engaged state of the lock piece 83.

As shown in FIGS. 5A to 5C, the locking protrusion 36 is a protrusion provided on the outer side surface of the terminal accommodating portion 3*a* of the housing body 3 equipped with the terminal insertion hole 32 and inserted into the connector 2. As shown in FIG. 5B and FIG. 5C, this locking protrusion 36 engages with the lock piece 83 equipped in the connector 2 and regulates the movement in the direction away from the connector 1 when the fitting of the connector 1 and the connector 2 is completed as normal.

After the mounting of the terminal fitting 51 or the ferrite core 52 on the housing body 2 is completed, the cover 4 is attached to the housing body 3 and covers the top of the terminal fitting 51 and ferrite core 52 mounted on the housing body 3.

As shown by the arrow X2 in FIG. 3, the cover 4 is attached to the housing body 3 by a sliding operation in the same direction as the insertion direction of the ferrite core 52 into the ferrite accommodation chamber. As shown in FIG. 4, the cover 4 attached to the housing body 3 by the sliding operation shown in FIG. 3 is regulated in the movement in the vertical direction (up and down direction/direction of the arrow Y4 in FIG. 4) of the housing body 3 in a state where the guide protrusions 41 provided on the inner surfaces of both side walls facing the width direction are interposed between the lower surfaces of the guide ribs 39*a* of both outer sides of the ferrite accommodating portion 33 and the bottom portion flange portions 39*b*.

Further, the cover 4 attached to the housing body 3 is regulated in the movement in the removal direction (direction opposite to the arrow X2 in FIG. 3) by the engaging of an engagement portion (not shown) with a cover locking protrusion 38 as shown in FIG. 2.

As shown in FIG. 4, at the inner surface of the cover 4 facing the ferrite core 52 when attached to the housing body 3, a thickness increasing rib 43 extending along the insertion direction of the ferrite core 52 into the ferrite accommodation chamber 33*a* is provided. The thickness increasing rib 43 is received in the rib receiving groove 52*b* formed on the upper surface of the ferrite core 52.

In the connector 1 of this embodiment, as shown in FIG. 2A and FIG. 2B, when the ferrite core 52 is inserted and mounted in the ferrite accommodation chamber 33*a* of the housing body 3, the vertical movement prevention ribs 33*c* equipped in the ferrite accommodation chamber 33*a* engages with the engagement grooves 52*a* formed on both side surfaces of the ferrite core 52 and regulates the movement of the ferrite core 52 in the direction (direction of the arrow Y4 in FIG. 2B) along the insertion direction of the terminal fitting 51. That is, the ferrite core 52 is prevented from vertical movement away from the ferrite accommodation chamber 33*a* by the engagement of the vertical movement prevention ribs 33*c* and the engagement grooves 52*a*.

The ferrite embedded connector 1 in a state of complete assembly shown in FIG. 4 is fitted to the connector 2 as shown in FIGS. 5A to 5C.

As shown in FIG. 1 and FIGS. 5A to 5C, the connector 2 includes a substantially cylindrical housing body 7 in which pin terminals 71 are implanted, a guide member (shunt ring) 8 fitted into the housing body 7 and forming a fitting structure of the terminal accommodating portion 3*a*, and a short-circuit terminal 9 to be mounted inside the guide member 8. A fitting connection portion 51*a* is fitted to the pin terminals 71.

As shown in FIG. 5A, the short-circuit terminal 9 comes into contact with the pin terminals 71 implanted in the housing body 7, and the pin terminals 71 are short-circuited.

The guide member 8 has a lock piece 83 at the periphery of an accommodating portion fitting portion 81*a* which is a hole portion into which the terminal accommodating portion 3*a* is set. As shown in FIG. 5B and FIG. 5C, the lock piece 83 engages with the locking protrusion 36 equipped in the terminal accommodating portion 3*a* of the housing body 3 and regulates the movement in the direction away from the housing body 3 when the fitting of the connector 1 and the connector 2 is completed as normal.

Further, as shown in FIG. 5C, in a state where the engagement of the connector 1 and the connector 2 is completed as normal and the lock piece 83 is engaged with the locking protrusion 36, the slider 62 enters the rear portion of the lock piece 83 and regulates the movement in the engagement release direction of the lock piece 83.

In the ferrite embedded connector 1 according to the first embodiment described above, in a state where a terminal fitting 51 is inserted and mounted in a terminal insertion hole 32 of the housing body 3, and a ferrite core 52 through which an electric wire 53 connected to the terminal fitting 51 passes is inserted and mounted in the ferrite accommodating portion 33, even if a load in the direction (direction of the arrow Y4 of FIG. 2B) along the insertion direction of the terminal fitting 51 acts on the electric wire 53 from outside, the load in the direction along the insertion direction of the terminal fitting 51 is absorbed by regulating the movement of the ferrite core 52 using the engagement of the vertical movement prevention rib 33*c* and the engagement groove 52*a* and is not transmitted to the terminal fitting 51 accommodated in the housing body 3.

Therefore, it is possible to realize retention of the terminal fitting 51 even without providing a lance in the terminal fitting 51. Accordingly, the terminal fitting 51 accommodated in the housing body 3 is given a thin exterior in which the lance is left out as shown in the above-described embodiment and it is possible to set a thin structure which does not have a terminal insertion hole 32 of the housing body 3 or a concave portion which is an engagement location of the lance, and, by slimming the terminal fitting 51 and the terminal insertion hole 32, it is possible to reduce the size of the breadth (outer diameter) of the terminal accommodating portion 3*a* which is a part accommodating the terminal fitting 51 of the housing body 3 in comparison with the housing body of the related art in which the lance of the terminal fitting 51 was used for retention.

Accordingly, it is possible to avoid the inconvenience of the increasing of the size of the connectors 1 and 2 caused by increasing the size of the breadth of the part (terminal accommodating portion 3*a*) accommodating the terminal fitting 51 of the housing body 3.

Further, since there is no longer a need to equip a retaining lance in the terminal fitting 51, it is possible to avoid damage to or deformation of the terminal fitting 51 caused by interference of the lance. Therefore, for example, it is possible to avoid the occurrence of the problem of the deterioration of the assembly characteristic of the terminal fitting 51 in the ferrite embedded connector or the deterioration of the retention performance of the terminal fitting 51, that is, the problems caused by the damage to or deformation of the terminal fitting 51.

Further, in the ferrite embedded connector 1 of the first embodiment, the engagement of the vertical movement prevention protrusions 33*c* as a vertical movement prevention protrusion and the engagement grooves 52*a* as a protrusion engaging concave portion function as a guiding mechanism for slidably engaging the ferrite core 52 along the insertion direction to the ferrite accommodation chamber 33*a*. Therefore, it is possible to facilitate the insertion operation during the mounting of the ferrite core 52 to the ferrite accommodation chamber 33*a* and it is possible to improve the ease of assembly of the ferrite embedded connector.

Further, in the ferrite embedded connector 1 of the first embodiment, regarding the cover 4 facing the insertion direction of the ferrite core 52 and the terminal fitting 51 or the inner lower wall of the ferrite accommodation chamber 33*a* facing the cover 4, by making the portion equipped with thickness increasing ribs 33*e* and 43 thicker than the other parts and equipping a gate for filling the resin during the injection molding at the position where the thickness increasing ribs 33*e* and 43 are equipped, it is possible to improve the fluidity of the resin during injection molding.

Accordingly, even if the inner lower wall of the ferrite accommodation chamber 33 facing the cover 4 or the cover 4 are thinned, it is possible to prevent deterioration of the fluidity of the resin during injection molding and it is possible to inhibit deterioration of formability caused by the deterioration of the fluidity of the resin.

Therefore, by thinning the inner lower wall of the ferrite accommodating portion 33 facing the cover 4 and the wall portion dividing the ferrite accommodation chamber 33*a* such as the cover 4, the height length of the periphery of the ferrite accommodation chamber 33*a* is reduced and it is possible to achieve a lowering of the profile of the connector.

Here, the ferrite embedded connector of the present disclosure is not limited to the above-described embodiments and appropriate modifications, improvements, and the like are possible.

For example, the vertical movement prevention protrusion provided in the ferrite accommodation chamber 33*a* is not limited to the rib structure shown in the first embodiment. For example, a hemispherical protrusion may be provided as the vertical movement prevention protrusion. Further, the protrusion engaging concave portion provided in the ferrite core 52 for engaging with the vertical movement prevention protrusion is not limited to the groove shape shown in the first embodiment.

Further, the attachment structure of the cover 4 attached to the housing body 3 is also not limited to the structure shown in the first embodiment. It is possible to set an attachment structure allowing engagement with the housing body 3 by pressing the cover into the top of the one side surface 31 of the housing body 3 similarly to the insertion direction of the terminal fitting 51 into the terminal insertion hole 32.

Further, the positions and the number of the thickness increasing ribs provided on the cover 4 or the inner lower wall of the ferrite accommodating portion 33 and the positions and the number of the rib receiving grooves provided on the ferrite core 52 are also not limited to the first embodiment.

Figure 6:
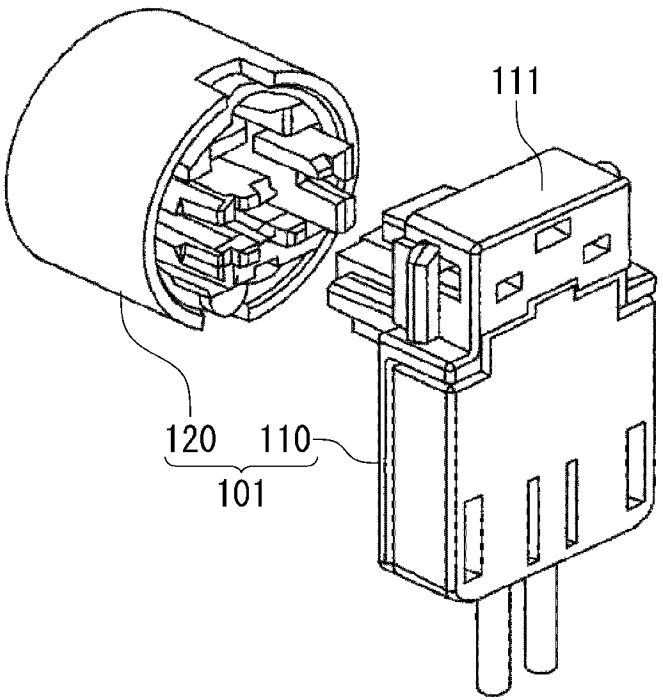
FIG. 6 is an exploded perspective view of one embodiment of the electrical connector according to the present disclosure.
Figure 7:
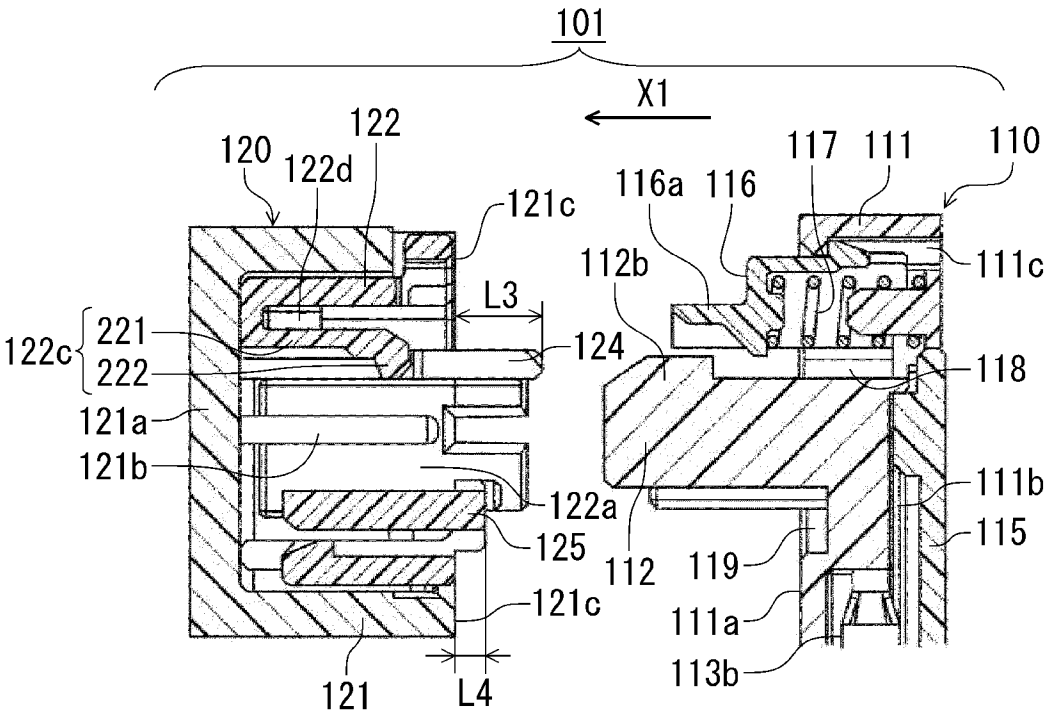
FIG. 7 is a longitudinal sectional view of the harness side connector and the accessory side connector shown in FIG. 6.
Figure 8:
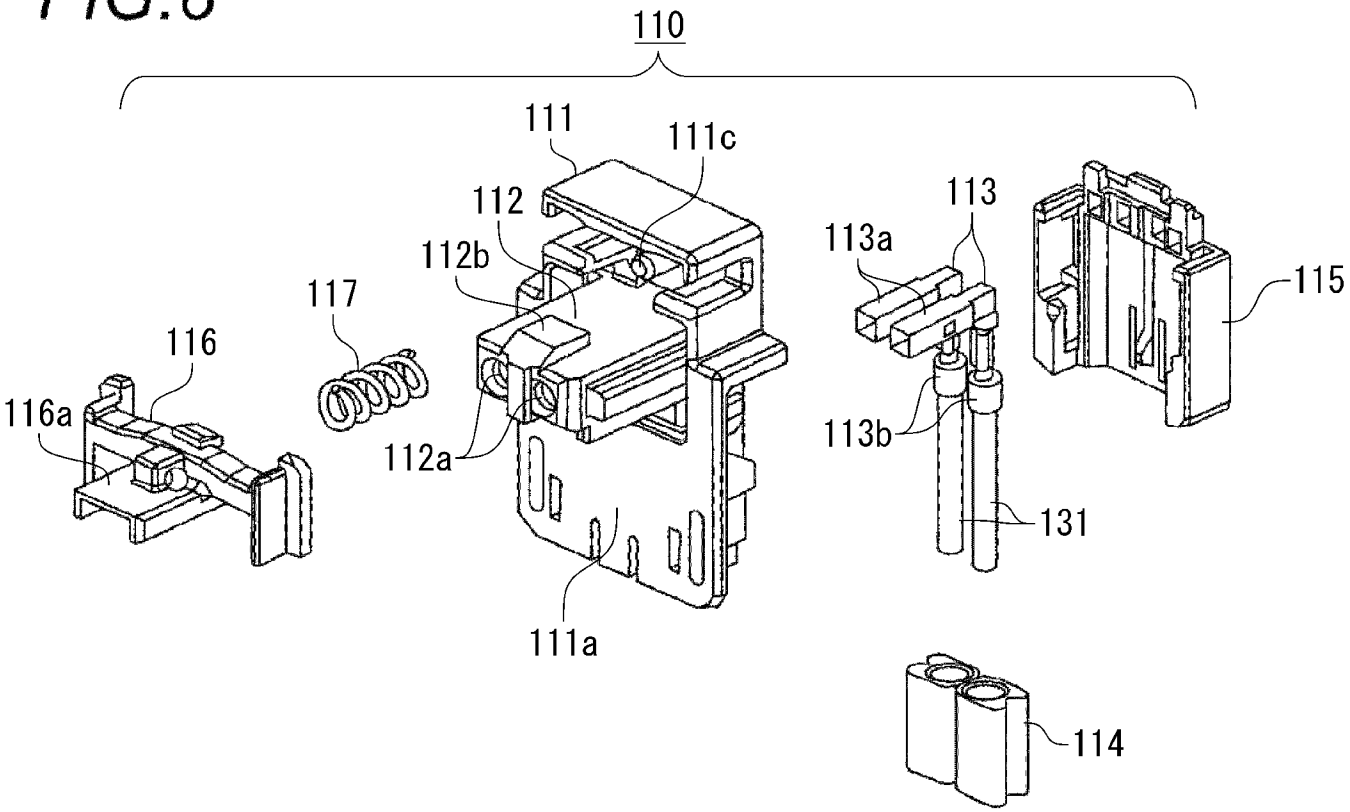
FIG. 8 is an exploded perspective view of the harness side connector shown in FIG. 6.
Figure 9:
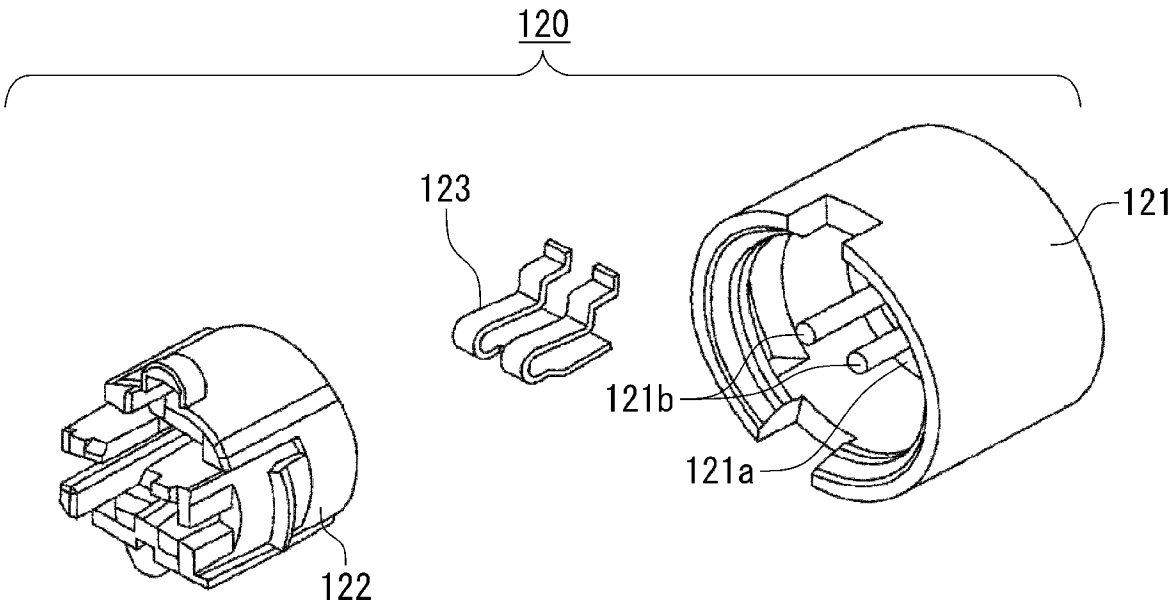
FIG. 9 is an exploded perspective view of the accessory side connector shown in FIG. 6.

FIGS. 6 to 9 show the electrical connector according to a second embodiment of the present disclosure. FIG. 6 is an exploded perspective view of the electrical connector of the second embodiment, FIG. 7 is a longitudinal sectional view of the harness side connector and the accessory side connector shown in FIG. 6, FIG. 8 is an exploded perspective view of the harness side connector shown in FIG. 6, and FIG. 9 is an exploded perspective view of the accessory side connector shown in FIG. 6.

The electrical connector 101 of a second embodiment is used for supplying electricity to a squib (heating element) equipped in an inflator of a vehicle-mounted airbag system, and includes a harness side connector 110 (first connector) and an accessory side connector 120 (second connector) to which the harness side connector 110 is fitted, and, in the accessory side connector 120, jam prevention protrusions 124 and 125 are provided.

As shown in FIGS. 7 and 8, the harness side connector 110 includes a housing body 111, a terminal holding portion 112, a female terminal fitting 113, a ferrite core 114, a cover 115, a slider 116, and a spring 117.

In the housing body 111, a lower surface 111*a* facing the accessory side connector 120 is made to come into contact with a leading edge surface 121*c* of the holder 121 of the accessory side connector 120. Although not shown, on the upper surface 111*b* side which is the opposite side to the lower surface 111*a*, the housing body 111 includes a terminal base end accommodating portion, an electric wire accommodating portion, and a ferrite accommodating portion. The terminal base end accommodating portion has a concave portion accommodating the base end portion of the female terminal fitting 113. The electric wire accommodating portion has a concave portion accommodating the end portion of the electric wire 131 connected to the base end portion of the female terminal fitting 113. The ferrite accommodating portion has a concave portion accommodating the ferrite core 114 mounted on the electric wire 131.

As shown in FIGS. 7 and 8, a slider accommodating portion 111*c* is formed at a position adjacent to the terminal holding portion 112 on the lower surface 111*a* of the housing body 111. The slider accommodating portion 111*c* has a concave portion accommodating the slider 116 so as to be slidable in a direction fitting into the harness side connector 120.

The terminal holding portion 112 is integrally formed with the housing body 111 so as to protrude from the lower surface 111*a* of the housing body 111 to the accessory side connector 120 side. The terminal holding portion 112 accommodates the end portion of the electric wire 131 of the wire harness and is inserted into the fitting space 122*a* of the accessory side connector 120 to be described later. As shown in FIGS. 7 and 8, a coupling protrusion 112*b* is provided on the outer surface of the terminal holding portion 112. When the assembly of the harness side connector 110 to the accessory side connector 120 is completed, this coupling protrusion 112*b* engages with a locking arm 122*c* equipped in the accessory side connector 120, whereby the connectors are set to a state of being fitted to each other.

As shown in FIG. 8, the female terminal fitting 113 is a terminal fitting 113 in which the fitting connection portion 113*a* and the base end portion 113*b* are bent in an L-shape, and the fitting connection portion 113*a* is accommodated in the terminal accommodating hole 112*a* of the terminal holding portion 112.

The base end portion 313*b* of the female terminal fitting 113 is accommodated in the terminal base end accommodating portion of the housing body 111. An end portion of the electric wire 131 of the wire harness is connected to the base end portion 103*b* of the female terminal fitting 113.

The ferrite core 104 is formed in a block shape by a metal oxide ferromagnetic body. The ferrite core 104 is provided on the electric wire 131 as a noise suppression part preventing noise current due to electromagnetic waves from the outside from flowing to the electric wire 131.

As shown in FIG. 7, the cover 115 is attached to the upper surface 111*b* of the housing body 111, and covers the top of the female terminal fitting 113 mounted on the housing body 111, the electric wire 131, and the ferrite core 114. The cover 115 is detachably attached to the housing body 111.

The slider 116 is accommodated in a slider accommodating portion 111*c* of the housing body 111 so as to be slidable along the fitting direction to the harness side connector 120. When the assembly of the harness side connector 110 to the accessory side connector 120 is completed, the slider 116 fits into the spacer setting portion 122*d* adjacent to a locking arm 122*c* to be described later, regulates the displacement in the direction in which the locking arm 122*c* moves away from the coupling protrusion 112*b*, and locks the link between the housings using the locking arm 122*c*.

As shown in FIG. 7, the spring 117 is arranged between the bottom part of the slider accommodating portion 111*c* and the slider 116 in a compressed condition and biases the slider 116 in a protruding direction.

Further, in second embodiment, protrusion accommodating portions 118 and 119 for accommodating the leading edge portion of the jam prevention protrusions 124 and 125 are formed on a lower surface 111*a* of the housing body 111 continuous to the base portion of the terminal holding portion 112 such that the lower surface 111*a* which is the leading edge surface of the housing body 111 comes into contact with the leading edge surface 121*c* of the holder 121.

The protrusion accommodating portion 118 has a concave portion accommodating the leading edge portion of the jam prevention protrusion 124. Further, the protrusion accommodating portion 119 has a concave portion accommodating the leading edge portion of the jam prevention protrusion 125.

The harness connector 110 described above is a so-called ferrite embedded connector accommodating a ferrite core 114 mounted as a noise suppression part on the electric wire 131 connected to the female terminal fitting 113.

As shown in FIGS. 7 and 9, the accessory side connector 120 includes a holder 121 fixed to the inflator of an airbag system, a fitting portion forming member (shunt ring) 122 fitted to the holder 121, a short-circuit terminal 123 held inside the fitting portion forming member 122, and jam prevention protrusions 124 and 125.

The holder 121 is formed in a bottomed cylindrical shape. In the center of the bottom portion 121*a* of the holder 121, a pair of pin terminals 121*b* (male terminals) fitting into the female terminal fitting 113 are provided. The pair of pin terminals 121*b* are terminals supplying electricity to a squib (heating element) equipped in the inflator.

The fitting portion forming member 122 is mounted on the holder 121 so that the pin terminals 121*b* pass therethrough and forms a fitting space 122*a*, into which the terminal holding portion 112 of the harness side connector 110 is fitted, inside the holder 121.

Further, as shown in FIG. 7, a locking arm 122*c* and a spacer setting portion 122*d* are provided in the fitting portion forming member 122.

As shown in FIG. 7, the locking arm 122*c* has an engaging protrusion 222, which is capable of engaging with the coupling protrusion 112*b* of the terminal holding portion 112, at the leading edge of an arm 221 extending along the fitting direction of the terminal holding portion 112.

As shown in FIG. 7, the spacer setting portion 122*d* has a concave portion equipped to be adjacent to the locking arm 122*c*, and, when the fitting connection of the connectors to each other is completed, the leading edge portion 116*a* of the slider 116 is set therein.

When the female terminal fitting 113 accommodated in the harness side connector 110 is unconnected with the pair of pin terminals 121*b*, the short-circuit terminal 123 is supported by the fitting portion forming member 122 so as to make a short circuit connection between the pair of pin terminals 121*b* and prevent erroneous operation of the squib. The short circuit connection between the pair of pin terminals 121*b* due to the short-circuit terminal 123 is cancelled when the conductive connection of the female terminal fitting 113 and the pin terminals 121*b* is completed due to the fitting connection of the harness side connector 110 and the accessory side connector 120.

As shown in FIG. 7, the jam prevention protrusions 124 and 125 are integrally formed with the fitting portion forming member 122 so as to extend (stick out) along the fitting direction of the terminal holding portion 112 toward the fitting space 122*a*. These jam prevention protrusions 124 and 125 increase the sliding length between the terminal holding portion 112 inserted in the fitting space 122*a* and the fitting space 122*a*, whereby the inclination of the terminal holding portion 112 inserted in the fitting space 122*a* during the operation of fitting the connectors to each other is regulated and the occurrence of the jam is prevented.

As shown in FIG. 7, in the case of the electrical connector 101 of this embodiment, the leading edge of the jam prevention protrusion 124 is set to a length protruding further to the outside than the leading edge surface 121*c* of the holder 121 by the length L3. Further, the leading edge of the jam prevention protrusion 125 is set to a length protruding further to the outside than the leading edge surface 121*c* of the holder 121 by the length L4.

The protrusion accommodating portion 118 of the housing body 111 has a depth accommodating the leading edge portion of the jam prevention protrusion 124 having the length L3. Further, the protrusion accommodating portion 119 of the housing body 111 has a depth accommodating the leading edge portion of the jam prevention protrusion 125 having the length L4.

The harness side connector 120 is an electrical connector for the squib equipped in the inflator of a vehicle-mounted airbag system.

The operation during the fitting and connecting of the harness side connector 110 and the accessory side connector 120 described above will be described based on FIGS. 10 and 11.

Figure 10:
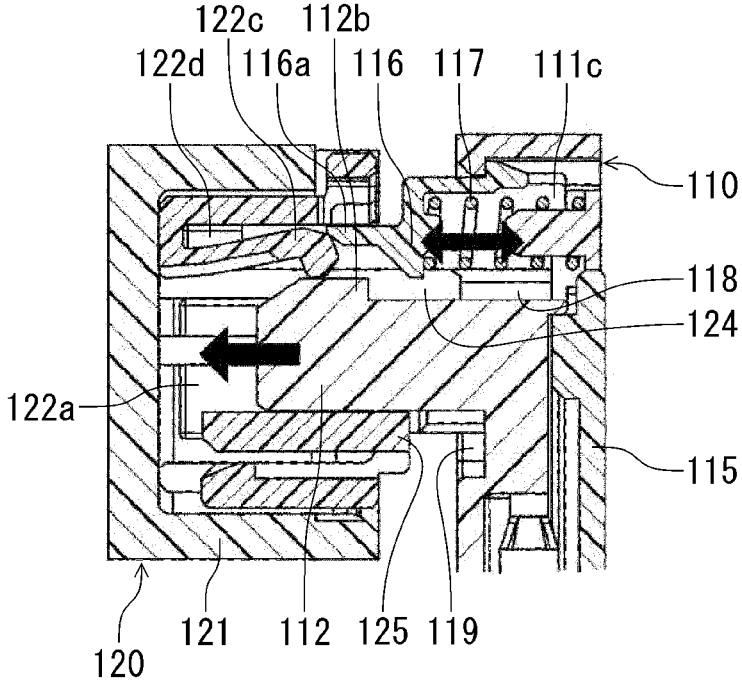
FIG. 10 is a longitudinal sectional view showing a state at the time of starting of the fitting of the harness side connector and the accessory side connector shown in FIG. 7.
Figure 11:
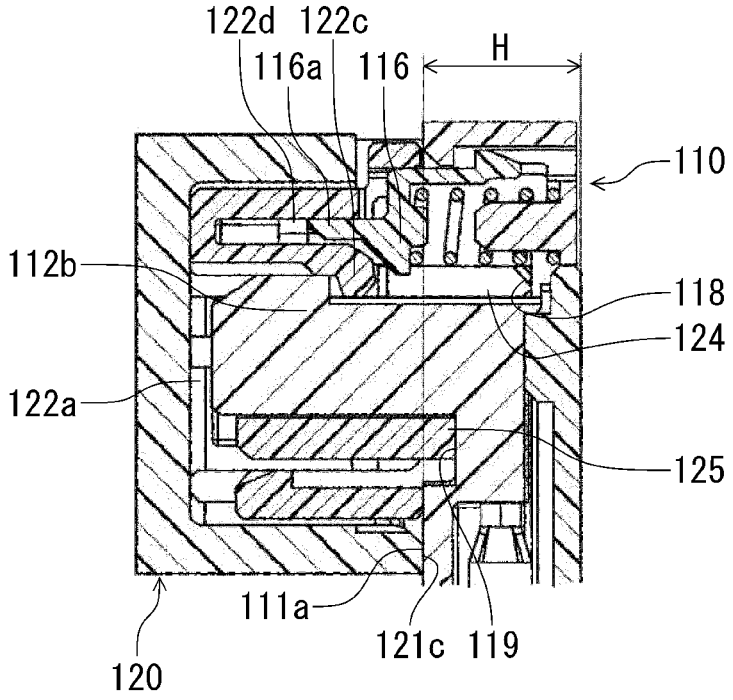
FIG. 11 is a longitudinal sectional view showing a state at the time of the completion of the fitting of the harness side connector and the accessory side connector shown in FIG. 7.

FIG. 10 is a longitudinal sectional view showing a state at the time of starting of the fitting of the harness side connector and the accessory side connector shown in FIG. 7 and FIG. 11 is a longitudinal sectional view showing a state at the time of the completion of the fitting of the harness side connector and the accessory side connector shown in FIG. 7.

As shown in FIG. 10, in a case where the fitting of the harness side connector 110 and the accessory side connector 120 is being performed, the locking arm 122*c* is retracted to the outside of the terminal holding portion 112 along with the insertion of the terminal holding portion 112 into the fitting space 122*a*. The leading edge portion of the locking arm 122*c* retracted to the outside covers the path of the slider 116 equipped in the harness side connector 110. Therefore, in a case where the fitting of the connectors to each other is being performed, the slider 116 resists the biasing force of the spring 117 and is pushed back into the slider accommodating portion 111*c*.

As shown in FIG. 11, when the fitting of the harness side connector 110 and the accessory side connector 120 is completed, the locking arm 122*c* of the fitting portion forming member 122 is engaged with the coupling protrusion 112*b* of the terminal holding portion 112 and the connectors enter a state of being linked to each other. Further, since the locking arm 122*c* enters a state of being engaged with the coupling protrusion 112*b*, the path of the slider 116 is opened. Therefore, the slider 116 is sent out into the fitting space 122*a* due to the biasing force of the spring 117 and the leading edge portion 116*a* of the slider 116 is set into the spacer setting portion 122*d* arranged to be adjacent to the locking arm 122*c*. Since the bending of the locking arm 122*c* in the engagement releasing direction is regulated by the setting of the leading edge portion 116*a* of the slider 116 into the spacer setting portion 122*d*, the linked state of the harness side connector 110 and the accessory side connector 120 is locked.

Further, as shown in FIG. 11, when the fitting of the harness side connector 110 and the accessory side connector 120 is completed, the leading edge portions of the jam prevention protrusions 124 and 125 provided on the fitting portion forming member 122 are accommodated in the protrusion accommodating portions 118 and 119 provided on the housing body 111 and the lower surface 111*a* which is the leading edge surface of the housing body 111 and the leading edge surface 121*c* of the holder 121 are put into a state of contact with each other.

In the electrical connector 101 of the one embodiment described above, when the assembly of the harness side connector 110 with the accessory side connector 120 is completed, the leading edge portions of the jam prevention protrusions 124 and 125 protruding from the leading edge surface of the holder 121 shown in FIG. 11 are accommodated in the protrusion accommodating portions 118 and 119 provided in the housing body 111 of the harness side connector 110. Therefore, it is possible to obtain an assembled state in which the housing body 111 of the harness side connector 110 is in direct contact with the surface of the holder 121 without the housing body 111 of the harness side connector 110 vertically moving from the surface of the holder 121 due to the leading edge portions of the jam prevention protrusions 124 and 125 as in the related art.

That is, as shown in FIG. 11, the assembly height H of the harness side connector 110 protruding from the leading edge surface of the holder 121 matches the height dimension of the housing body 111 and the jam prevention protrusions 124 and 125 do not cause an increase in the assembly height.

Accordingly, since the jam is prevented when the connectors are fitted to each other, the jam prevention protrusions

124 and 125 equipped in the accessory side connector 120 can achieve a lowering of the profile without causing an increase in the assembly height of the connector.

Further, according to the electrical connector 101 of the one embodiment described above, since the profile of the connector supplying electricity to the squib (heating element) of the inflator of the vehicle-mounted airbag system is lowered, it is possible to promote space-saving with respect to the inflator.

Here, the electrical connector of the present disclosure is not limited by the respective embodiments described above, and suitable modifications, improvements, or the like are possible.

For example, the electrical connector according to the present disclosure is not limited to a connector supplying electricity to a squib in a vehicle-mounted airbag system, and can be applied to various types of electrical connectors having jam prevention protrusions.

Figure 12:
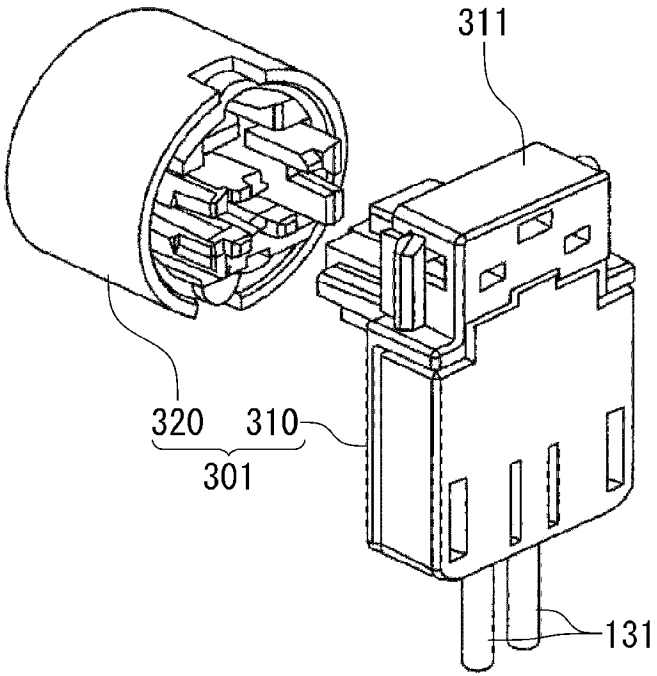
FIG. 12 is an exploded perspective view of one embodiment of the connector including the connector according to the present disclosure.

FIG. 12 is an exploded perspective view of an electrical connector according to a third embodiment of the present disclosure.

The connector 301 shown in FIG. 12 is used to supply electricity to a squib (heating element) equipped in an inflator of a vehicle-mounted airbag system and includes a harness side connector 310 and an accessory (inflator) side connector 320 to which the harness side connector 310 is fitted. Jam prevention protrusions 324 and 325 are provided on the accessory side connector 320.

Figure 13:
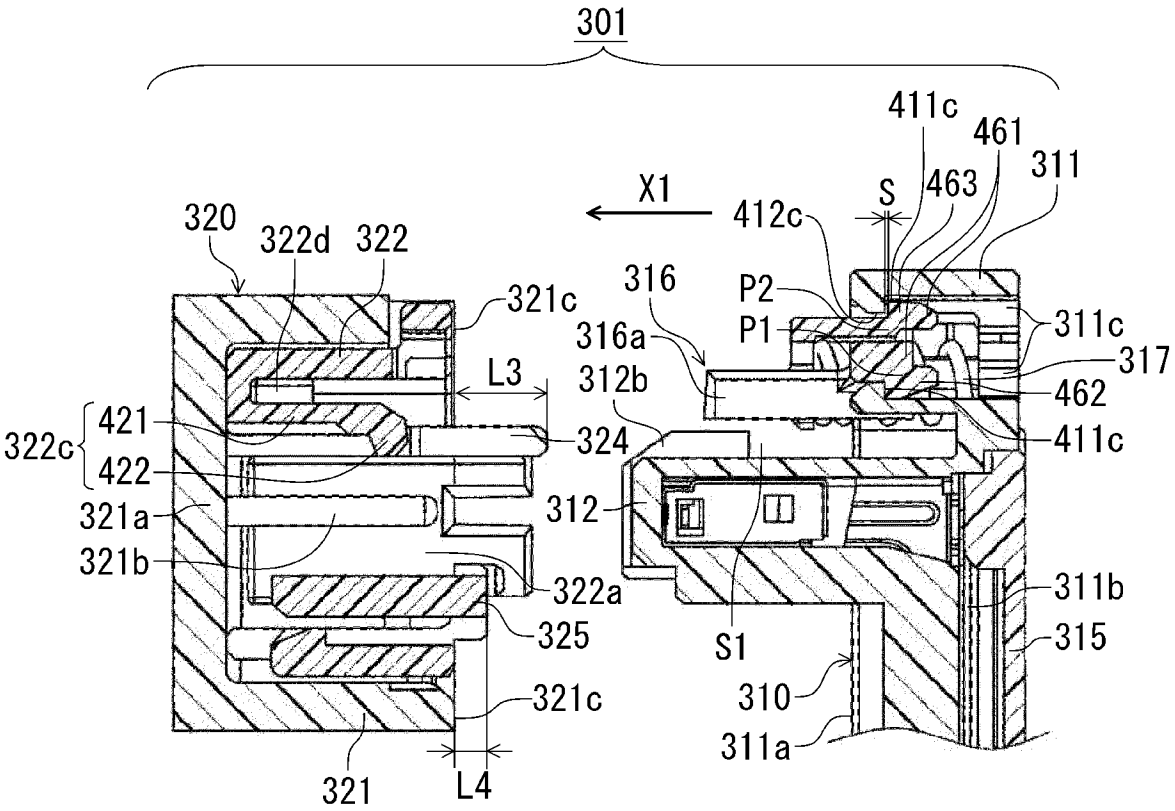
FIG. 13 is a longitudinal sectional view of each connector shown in FIG. 12.
Figure 14:
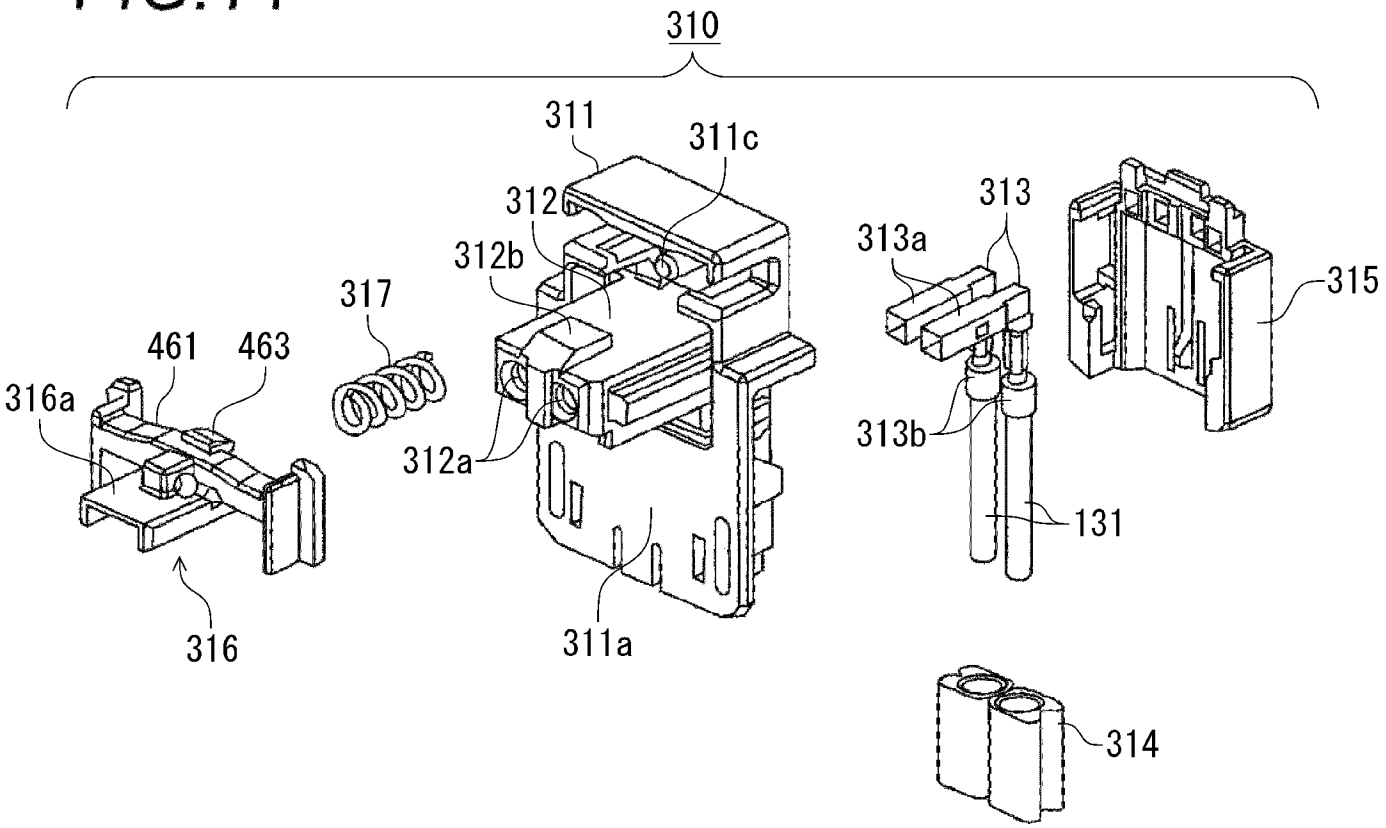
FIG. 14 is an exploded perspective view of a connector to which the electric wire of the harness shown in FIG. 12 is connected.

As shown in FIGS. 13 and 14, the harness side connector 3110 includes a housing body 3111, a terminal holding portion 3112, a female terminal fitting 3113, a ferrite core 3114, a cover 3115, a slider 3116, and a spring 3117.

In the housing body 3111, a lower surface 3111*a* facing the accessory side connector 3120 is made to come into contact with a leading edge surface 3121*c* of the holder 3121 of the accessory side connector 3120. Although not shown, on the upper surface 111*b* side which is the opposite side to the lower surface 3111*a*, the housing body 3111 includes a terminal base end accommodating portion, an electric wire accommodating portion, and a ferrite accommodating portion. The terminal base end accommodating portion has a concave portion accommodating the base end portion of the female terminal fitting 3113. The electric wire accommodating portion has a concave portion accommodating the end portion of the electric wire 3131 connected to the base end portion of the female terminal fitting 3113. The ferrite accommodating portion has a concave portion accommodating the ferrite core 3114 mounted on the electric wire 3131.

As shown in FIGS. 13 and 14, on the lower surface 311*a* of the housing body 311, a slider accommodating portion 311*c* is formed at a position separated from the terminal holding portion 312 by a predetermined distance. The slider accommodating portion 311*c* has a concave portion accommodating the slider 316 so as to be capable of sliding in the fitting direction to the accessory side connector 320.

The slider accommodating portion 311*c* includes a position aligning surface 411*c* regulating the movement of the slider 316 in the protruding direction. The position aligning surface 411*c* is arranged at the leading side of the sliding direction (the direction of the arrow X1 in FIG. 13) with respect to the first retaining protrusion 462 and the second retaining protrusion 463 provided on the periphery of the base portion 461 of the slider 316, and the position aligning surface 411*c* regulates the movement of the slider 316 in the protrusion direction by coming into contact with these retaining protrusions 462 and 463.

An opening 412*c* into which the center portion of the slider 316 is inserted is provided at the center of the position aligning surface 411*c*.

The terminal holding portion 312 is integrally formed with the housing body 311 so as to protrude from the lower surface 311*a* of the housing body 311 to the accessory side connector 320 side. The terminal holding portion 312 has a substantially cylindrical external appearance, accommodates the female terminal fitting 313 connected to the end portion of the electric wire 131 of the wire harness, and is inserted into the fitting space 322*a* of the accessory side connector 320.

The terminal holding portion 312 is integrally formed with the housing body 311 so as to protrude from the lower surface 311*a* of the housing body 311 to the accessory side connector 320 side. The terminal holding portion 312 accommodates the end portion of the electric wire 331 of the wire harness and is inserted into the fitting space 322*a* of the accessory side connector 320 to be described later. As shown in FIGS. 13 and 14, a coupling protrusion 312*b* is provided on the outer surface of the terminal holding portion 312. When the assembly of the harness side connector 310 to the accessory side connector 320 is completed, this coupling protrusion 312*b* engages with a locking arm 322*c* equipped in the accessory side connector 320, whereby the connectors are set to a state of being fitted to each other.

As shown in FIG. 14, the female terminal fitting 313 is a terminal fitting 313 in which the fitting connection portion 313*a* and the base end portion 313*b* are bent in an L-shape, and the fitting connection portion 313*a* is accommodated in the terminal accommodating hole 312*a* of the terminal holding portion 312.

The base end portion 313*b* of the female terminal fitting 313 is accommodated in the terminal base end accommodating portion of the housing body 311. An end portion of the electric wire 331 of the wire harness is connected to the base end portion 103*b* of the female terminal fitting 313.

The ferrite core 304 is formed in a block shape by a metal oxide ferromagnetic body. The ferrite core 304 is provided on the electric wire 331 as a noise suppression part preventing noise current due to electromagnetic waves from the outside from flowing to the electric wire 331.

As shown in FIG. 13, the cover 315 is attached to the upper surface 311*b* of the housing body 311, and covers the top of the female terminal fitting 313 mounted on the housing body 311, the electric wire 331, and the ferrite core 314. The cover 315 is detachably attached to the housing body 311.

In the slider 316, the base portion 461 is accommodated in the slider accommodating portion 311*c* of the housing body 311 so as to be capable of sliding along the fitting direction (specifically, the insertion direction into the fitting space 322*a* which is the direction of the arrow X1 in FIG. 13) to the accessory side connector 320.

As shown in FIG. 13, the slider 316 is separated from the terminal holding portion 312 by a predetermined distance and slides in a direction along the direction of the arrow X1 in FIG. 13.

The slider 316 includes a base portion 461 slidably moving along the protruding direction of the terminal holding portion 312 inside the slider accommodating portion 311*c*, a first retaining protrusion 462 provided on a first position P1 closest to the terminal holding portion 312 at the periphery of the base portion 461, and a second retaining protrusion 463 provided on a second position P2 which is at the opposite side to the first position P1 with the base portion 461 interposed therebetween at the periphery of the base portion 461.

In the case of this embodiment, as shown in FIG. 13, the second retaining protrusion 463 is arranged to be positionally deviated to the opposite side to the fitting direction to the accessory side connector 320 by a distance S in the direction of the arrow X1 with respect to the first retaining protrusion 462. Therefore, when the first retaining protrusion 462 comes into contact with the position alignment surface 411*c* in a state where the axis of the slider 316 is parallel to the axis of the terminal holding portion 312 (that is, the slider 316 is not inclined), a gap having the dimension S as shown in FIG. 13 is generated between the second retaining protrusion 463 and the slider accommodating portion 311*c*.

Figure 15:
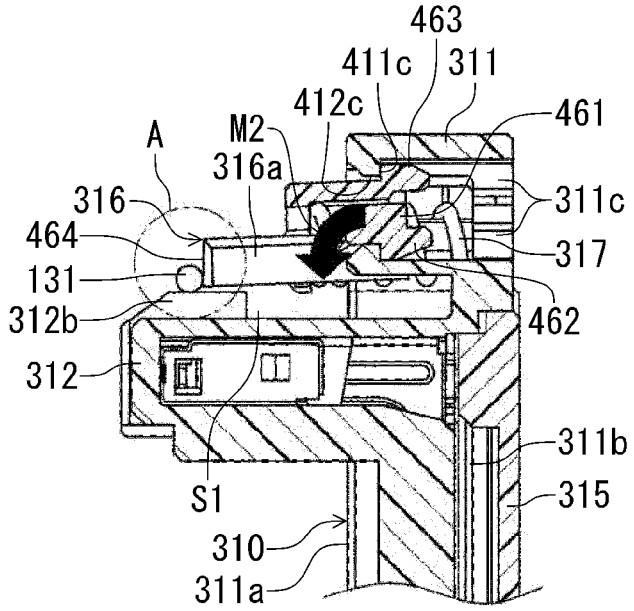
FIG. 15 is an explanatory diagram of the operation of a slider in the connector shown in FIG. 14.
Figure 16:
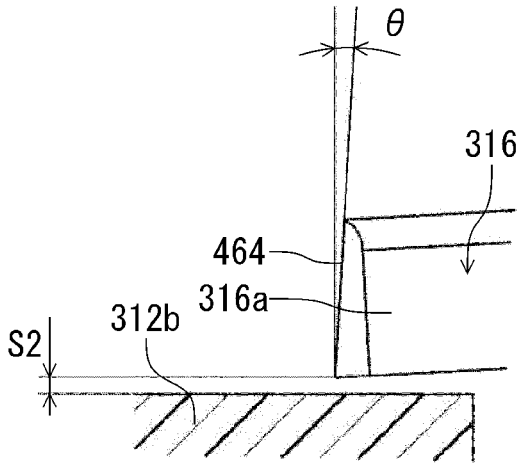
FIG. 16 is an expanded view of part A in FIG. 15.
Figure 17:
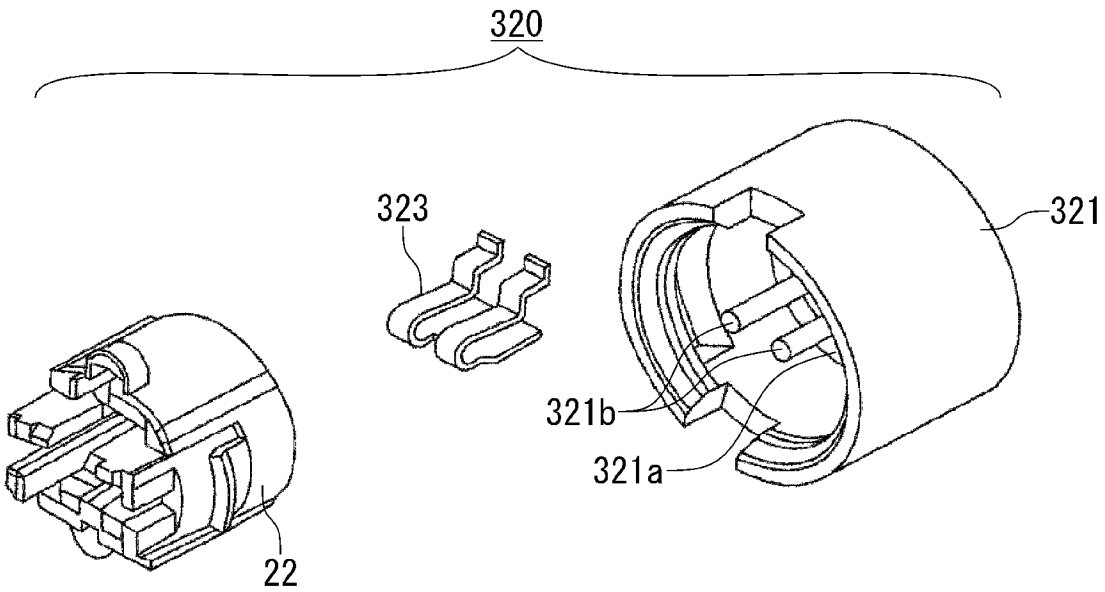
FIG. 17 is an exploded perspective view of an accessory side connector shown in FIG. 13.

Regarding the slider 316 of this embodiment, as shown in FIGS. 15 and 16, due to both the first retaining protrusion 462 and the second retaining protrusion 463 coming into contact with the position aligning surface 411*c*, the leading edge side of the slider 316 is inclined to the terminal holding portion 312 side as shown by the arrow M2 in FIG. 15, and the gap S1 between the slider 316 and the terminal holding portion 312 is set to an inclined state gradually becoming narrow toward the leading edge of the slider 316.

For example, during keeping or during transport or the like, in a state where the terminal holding portion 312 is not inserted into the fitting space 322*a* of the counterpart connector, the slider 316 in the connector 310 of this embodiment enters an inclined state where the gap S1 between the slider 316 and the terminal holding portion 312 gradually becomes narrow toward the leading edge of the slider 316 as shown in FIG. 15. Here, while in this inclined state, the separation distance between the leading edge portion 316*a* of the slider 316 and the terminal holding portion 312 is smaller than the standard separation distance necessary during a regular sliding operation of the slider 316. Here, as shown in FIG. 16, a gap S2 between the leading edge portion 16*a* of the slider 316 and the coupling protrusion 312*b* of the terminal holding portion 312 at this time is noticeably smaller than the outer diameter of the electric wire 131 connected to the housing body 311. Further, in the case of this embodiment, as shown in FIG. 16, to scoop up the electric wire 131 or the like collided therewith and to remove it to the outside, a scooping angle θ is given to the leading edge surface 464 of the leading edge portion 316*a* of the slider 316.

When the assembly of the harness side connector 310 to the accessory side connector 320 is completed, the slider 316 described above fits into a slider setting portion 322*d* adjacent to a locking arm 322*c* to be described later, regulates the displacement in the direction in which the locking arm 322*c* is separated from the coupling protrusion 312*b*, and the linking of the housings to each other is locked by the locking arm 322*c*.

As shown in FIG. 13, the spring 317 is arranged between the bottom part of the slider accommodating portion 311*c* and the slider 316 in a compressed condition and biases the slider 316 in a protruding direction.

Further, in second embodiment, protrusion accommodating portions 318 and 319 for accommodating the leading edge portion of the jam prevention protrusions 324 and 325 are formed on a lower surface 311*a* of the housing body 311 continuous to the base portion of the terminal holding portion 312 such that the lower surface 311*a* which is the leading edge surface of the housing body 311 comes into contact with the leading edge surface 321*c* of the holder 321.

The protrusion accommodating portion 318 has a concave portion accommodating the leading edge portion of the jam prevention protrusion 324. Further, the protrusion accommodating portion 319 has a concave portion accommodating the leading edge portion of the jam prevention protrusion 325.

The harness connector 310 described above is a so-called ferrite embedded connector accommodating a ferrite core 314 mounted as a noise suppression part on the electric wire 331 connected to the female terminal fitting 313.

As shown in FIGS. 13 and 16, the accessory side connector 320 includes a holder 321 fixed to the inflator of an airbag system, a fitting portion forming member (shunt ring) 322 fitted to the holder 321, a short-circuit terminal 323 held inside the fitting portion forming member 322, and jam prevention protrusions 324 and 325.

The holder 321 is formed in a bottomed cylindrical shape. In the center of the bottom portion 321*a* of the holder 321, a pair of pin terminals 321*b* (male terminals) fitting into the female terminal fitting 313 are provided. The pair of pin terminals 321*b* are terminals supplying electricity to a squib (heating element) equipped in the inflator.

The fitting portion forming member 322 is mounted on the holder 321 so that the pin terminals 321*b* pass therethrough and forms a fitting space 322*a*, into which the terminal holding portion 312 of the harness side connector 310 is fitted, inside the holder 321.

Further, as shown in FIG. 13, a locking arm 322*c* and a spacer setting portion 322*d* are provided in the fitting portion forming member 322.

As shown in FIG. 13, the locking arm 322*c* has an engaging protrusion 422, which is capable of engaging with the coupling protrusion 312*b* of the terminal holding portion 312, at the leading edge of an arm 221 extending along the fitting direction of the terminal holding portion 312.

As shown in FIG. 13, the spacer setting portion 322*d* has a concave portion equipped to be adjacent to the locking arm 322*c*, and, when the fitting connection of the connectors to each other is completed, the leading edge portion 316*a* of the slider 316 is set therein.

When the female terminal fitting 313 accommodated in the harness side connector 310 is unconnected with the pair of pin terminals 321*b*, the short-circuit terminal 323 is supported by the fitting portion forming member 322 so as to make a short circuit connection between the pair of pin terminals 321*b* and prevent erroneous operation of the squib. The short circuit connection between the pair of pin terminals 321*b* due to the short-circuit terminal 323 is cancelled when the conductive connection of the female terminal fitting 313 and the pin terminals 321*b* is completed due to the fitting connection of the harness side connector 310 and the accessory side connector 320.

As shown in FIG. 13, the jam prevention protrusions 324 and 325 are integrally formed with the fitting portion forming member 322 so as to extend (stick out) along the fitting direction of the terminal holding portion 312 toward the fitting space 322*a*. These jam prevention protrusions 324 and 325 increase the sliding length between the terminal holding portion 312 inserted in the fitting space 322*a* and the fitting space 322*a*, whereby the inclination of the terminal holding portion 312 inserted in the fitting space 322*a* during the operation of fitting the connectors to each other is regulated and the occurrence of the jam is prevented.

As shown in FIG. 13, in the case of the electrical connector 301 of this embodiment, the leading edge of the jam prevention protrusion 324 is set to a length protruding further to the outside than the leading edge surface 321*c* of the holder 321 by the length L3. Further, the leading edge of the jam prevention protrusion 325 is set to a length protruding further to the outside than the leading edge surface 321*c* of the holder 321 by the length L4.

The protrusion accommodating portion 318 of the housing body 311 has a depth accommodating the leading edge portion of the jam prevention protrusion 324 having the length L3. Further, the protrusion accommodating portion 319 of the housing body 311 has a depth accommodating the leading edge portion of the jam prevention protrusion 325 having the length L4.

The harness side connector 320 is an electrical connector for the squib equipped in the inflator of a vehicle-mounted airbag system.

The operation during the fitting and connecting of the harness side connector 310 and the accessory side connector 320 described above will be described based on FIGS. 18 and 19.

Figure 18:
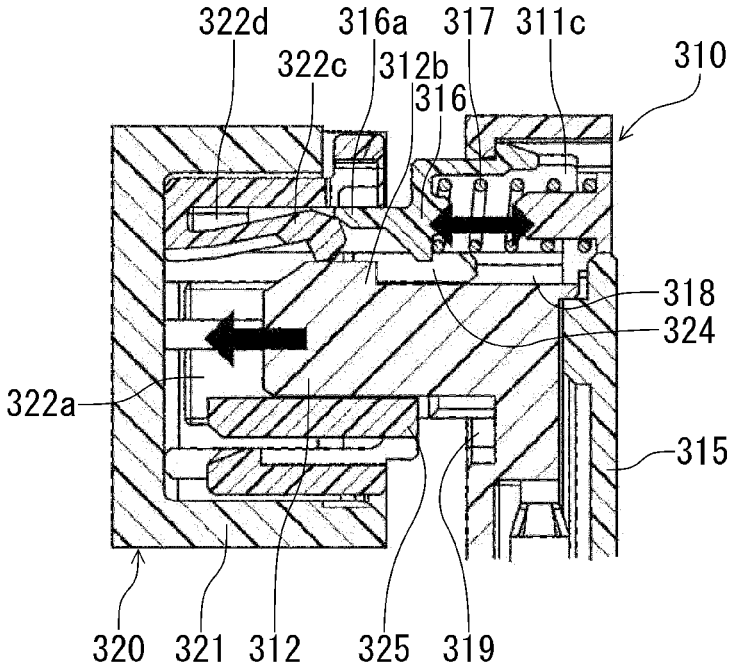
FIG. 18 is a longitudinal sectional view showing a state during the fitting of the connectors shown in FIG. 12 to each other.
Figure 19:
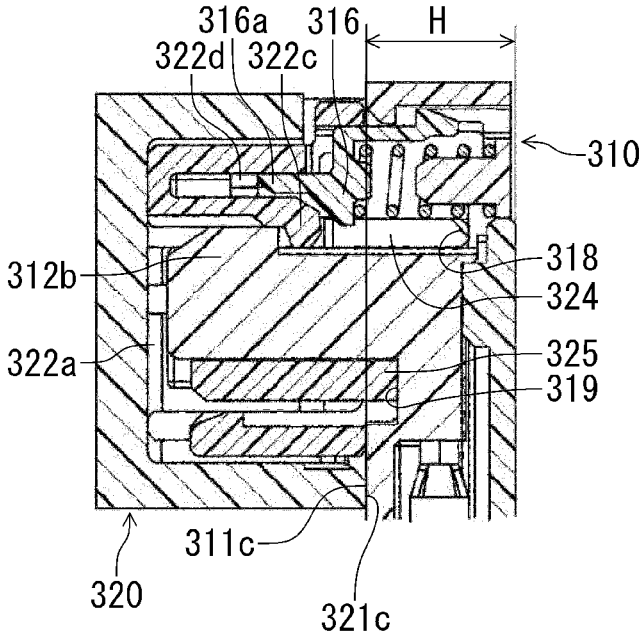
FIG. 19 is a longitudinal sectional view showing a state when the fitting of the connectors shown in FIG. 12 to each other is completed.

FIG. 18 is a longitudinal sectional view showing a state during the fitting of the harness side connector and the accessory side connector shown in FIG. 13 to each other and FIG. 19 is a longitudinal sectional view showing a state when the fitting of the harness side connector and the accessory side connector shown in FIG. 13 is completed.

During the fitting of the harness side connector 310 and the accessory side connector 320, as shown in FIG. 18, the locking arm 322*c* is retreated to the outside of the terminal holding portion 312 along with the insertion of the terminal holding portion 312 into the fitting space 322*a*. The leading edge portion of the locking arm 322*c* retreated to the outside covers the path of the slider 316 equipped in the harness side connector 310. Therefore, during the fitting of the connectors to each other, the slider 316 resists the biasing force of the spring 317 and is pushed back inside the slider accommodating portion 311*c*.

When the fitting of the harness side connector 310 and the accessory side connector 320 is completed, as shown in FIG. 19, the locking arm 322*c* of the fitting portion forming member 322 is engaged with the coupling protrusion 312*b* of the terminal holding portion 312 and the connectors enter a state of being linked to each other. Further, since the locking arm 322*c* enters an engaged state with the coupling protrusion 312*b*, the path of the slider 316 is opened. Therefore, the slider 316 is sent out into the fitting space 322*a* by the biasing force of the spring 317 and the leading edge portion 316*a* of the slider 316 is set in the slider setting portion 322*d* arranged to be adjacent to the locking arm 322*c*. Since the bending of the locking arm 322*c* in the engagement release direction is regulated by the setting of the leading edge portion 316*a* of the slider 316 in the slider setting portion 322*d*, the linked state of the harness side connector 310 and the accessory side connector 320 is locked.

Further, when the fitting of the harness side connector 310 and the accessory side connector 320 is completed, as shown in FIG. 19, the leading edge portions of the jam prevention protrusions 324 and 325 provided on the fitting portion forming member 322 are accommodated in the protrusion accommodating portions 318 and 319 provided on the housing body 311, and the lower surface 311*a* which is the leading edge surface of the housing body 311 and the leading edge surface 321*c* of the holder 321 enter a state of being in contact with each other.

In an initial state where the harness side connector 310 in the connector 301 of this embodiment described above is not connected to a counterpart connector (accessory side connector 320), as shown in FIGS. 15 and 16, the slider 316 is maintained in an inclined state in which the separation distance between the leading edge portion 316*a* of the slider 316 and the terminal holding portion 312 is smaller than the standard separation distance necessary during a regular sliding operation. Therefore, even when performing positional alignment in which the leading edge side of the slider 316 is inclined in a direction separating from the terminal holding portion 312 due to forming errors or the like, it is possible to keep the separation distance between the leading edge 316*a* of the slider 316 and the terminal holding portion 312 in a range that does not exceed the standard separation distance necessary during a regular sliding operation.

Accordingly, if the standard separation distance necessary during a regular sliding operation is set to the outer diameter or less of the electric wire for which there is a possibility of contact with the connector during keeping or during transport, it is possible to prevent a problem in which the electric wire or the like becomes wedged in the gap between the terminal holding portion 312 and the slider 316.

Further, according to the harness side connector 310 shown in the above-described embodiment, as shown in FIG. 16, since a scooping angle θ is given to the leading edge surface 464 of the leading edge portion 316*a* of the slider 316 to scoop up and remove the electric wire 131 or the like coming into contact therewith, it is possible to more reliably prevent the electric wire or the like from being wedged between the slider 316 and the terminal holding portion 12.

Further, according to the harness side connector 310 shown in the above-described embodiment, the inclination of the slider 316 is determined according to deviation in the direction of the arrow X1 of the positions of the first retaining protrusion 462 and the second retaining protrusion 463 arranged to face the leading edge portion 461 of the slider 316.

Therefore, with regard to the housing body 311, the terminal holding portion 312 and the slider accommodating portion 311*c*, it is possible to adjust the inclination of the slider 316 to a predetermined value and to easily realize changes in the inclination of the slider 316 simply by changing the setting of the base portion 461 of the slider 316 without adding specific setting changes.

Here, the electrical connector of the present disclosure is not limited by the respective embodiments described above, and suitable modifications, improvements, or the like are possible.

For example, the technique of the connector of the present disclosure is not limited to a connector supplying electricity to a squib in a vehicle-mounted airbag system, and can be applied to various types of connectors equipped with sliders separating from the terminal holding portion.

Further, the structure performing positional alignment of the slider during keeping or during transport of the connector in a posture of an inclined state in which the electric wire or the like is not easily wedged in is not limited to a structure in which the positions of the two retaining protrusions of the base end of the slider are deviated in the direction of the arrow X1 in FIG. 13. Instead of this, for example, the positions of the two retaining protrusions may be set to be matched in the axis direction, and the position aligning surface 411*c* of the slider accommodating portion 311*c* contacted by these retaining protrusions may be set to an inclined plane.

However, it is easier to realize a structure in which the positions of the two retaining protrusions are deviated than a structure in which the position aligning surface 411*c* inside the slider accommodating portion 311*c* is formed in an inclined plane.

Here, the details of the above embodiments are summarized as follows.

(1) There is provided an electrical connector comprising:

a housing body; and a cover attached to the housing body so as to cover an opening formed in a surface of the housing body, wherein the housing body includes:

a terminal accommodating hole that accommodates a terminal fitting connected to an end portion of an electric wire; and a ferrite accommodating portion that accommodates a ferrite core attached to the electric wire;

wherein the cover covers the terminal fitting and the ferrite core attached to the housing body;

wherein the ferrite accommodating portion includes:

a ferrite accommodation chamber into which the ferrite core is inserted in a first direction perpendicular to a second direction in which the terminal fitting is inserted into the terminal accommodating hole; and protrusions provided on both inner side surfaces of the ferrite accommodation chamber facing in a third direction perpendicular to the first direction; and wherein the protrusions are engaged with concave portions formed on both side surfaces of the ferrite core to regulate movement of the ferrite core in the second direction.

According to the configuration of the above-described (1), in a state where the terminal fitting is inserted in the terminal accommodating hole of the housing body and the ferrite core through which the electric wire connected to the terminal fitting passes is inserted and mounted in the ferrite accommodating portion, even if a load in the direction along the insertion direction of the terminal fitting acts on the electric wire from outside, the load in the direction along the insertion direction of the terminal fitting is absorbed by regulating the movement of the ferrite core using the engagement of the protrusion and the concave portion and is not transmitted to the terminal fitting accommodated in the housing body.

Therefore, it is possible to realize retention of the terminal fitting even without providing a lance in the terminal fitting. Accordingly, the terminal fitting accommodated in the housing body is given a thin exterior in which the lance is left out and it is possible to set a slim structure which does not have a terminal accommodating hole of the housing body or a concave portion which is an engagement location of the lance, and, by thinning the terminal fitting and the terminal accommodating hole, it is possible to reduce the size of the breadth of the part accommodating the terminal fitting of the housing body in comparison with the housing body of the related art in which the lance of the terminal fitting was used for retention.

Accordingly, it is possible to avoid the inconvenience of the increasing of the size of the connector caused by increasing the size of the breadth of the part accommodating the terminal fitting of the housing body.

Further, since there is no longer a need to equip a retaining lance in the terminal fitting, it is possible to avoid damage to or deformation of the terminal fitting caused by interference of the lance. Therefore, for example, it is possible to avoid the occurrence of the problem of the deterioration of the assembly characteristic of the terminal fitting in the ferrite embedded connector or the deterioration of the retention performance of the terminal fitting, that is, the problems caused by damage to or deformation of the terminal fitting.

(2) For example, the protrusions are ribs which extend along the first direction on the both inner side surfaces of the ferrite accommodating chamber, and the concave portions are engagement grooves formed on the both side surfaces of the ferrite core so that the ferrite core is slidable along the first direction with respect to the ferrite accommodation chamber.

According to the configuration of the above-described (2), the engagement of the ribs and the engagement groove functions as a guiding mechanism slidably linking the ferrite core along the insertion direction to the ferrite accommodation chamber. Therefore, it is possible to facilitate the insertion operation during the mounting of the ferrite core to the ferrite accommodation chamber and it is possible to improve the ease of assembly of the ferrite embedded connector.

(3) For example, thickness increasing ribs extending along the first direction are provided on an inner surface of the cover and an inner lower surface of the ferrite accommodation chamber which face surfaces of the ferrite core in the second direction, and rib receiving grooves for receiving the thickness increasing ribs are formed on the surfaces of the ferrite core facing the inner surface of the cover and the inner lower surface of the ferrite accommodation chamber.

According to the configuration of the above-described (3), regarding the cover facing in the first direction or the inner lower wall of the ferrite accommodation chamber facing the cover in the first direction, by making the portion equipped with a thickness increasing rib thicker than the other parts and equipping a gate for filling the resin during the injection molding at the position where the thickness increasing rib is equipped, it is possible to improve the fluidity of the resin during injection molding. Accordingly, even if the inner lower wall of the ferrite accommodation chamber facing the cover or the cover are thinned, it is possible to prevent deterioration of the fluidity of the resin during injection molding and it is possible to inhibit deterioration of formability caused by the deterioration of the fluidity of the resin.

Therefore, by thinning the inner lower wall of the ferrite accommodating portion facing the cover and the wall portion dividing the ferrite accommodation chamber such as the cover, the height dimension of the periphery of the ferrite accommodation chamber is reduced and it is possible to achieve a lowering of the profile of the connector.

(4) There is also provided an electrical connector comprising:

a first connector that accommodates a female terminal fitting connected to an end portion of an electric wire of a wire harness; and a second connector that is fitted with the first connector, wherein the first connector includes:

a housing body; and a terminal holding portion which is formed so as to be protruded from the housing body and is inserted into a fitting portion of the second connector;

wherein the second connector includes:

a holder having a male terminal to which the female terminal fitting is fitted;

a fitting portion forming member which forms the fitting portion inside the holder when the fitting portion forming member is attached to the holder so that the male terminal is passed through the holder;

a jam prevention protrusion which is integrally formed with the fitting portion forming member and extends along an insertion direction of the terminal holding portion into the fitting space to regulate inclination of the terminal holding portion during an operation of fitting the first and second connectors to each other;

wherein a leading edge portion of the jam prevention protrusion is set to a length protruding outside further than a leading edge surface of the holder;

wherein a protrusion accommodating portion is formed in the housing body which is continuous to a base end of the terminal holding portion; and wherein the protrusion accommodating portion accommodates the leading edge portion of the jam prevention protrusion so that a leading edge surface of the housing body comes into contact with the leading edge surface of the holder.

According to the configuration of (4), when the assembly of the first connector with the second connector is completed, the leading edge portion of the jam prevention protrusion protruding from the leading edge surface of the holder is accommodated in the protrusion accommodating portion provided in the housing body of the first connector. Therefore, similarly to the related art, due to the leading edge portion of the jam prevention protrusion, it is possible to obtain an assembled state in which the housing body of the first connector is directly in contact with the surface of the holder without the housing body of the first connector separating from the surface of the holder.

That is, the assembly height of the first connector protruding from the leading edge surface of the holder matches the height dimension of the housing body and the jam prevention protrusion does not cause an increase in the assembly height.

Accordingly, the jam prevention protrusion provided at the second connector for preventing jam when the first and second connectors are fitted to each other can achieve profile lowering without causing an increase in the assembly height of the connector.

(5) For example, the first connector is a ferrite embedded connector which accommodates a ferrite core attached to an electric wire connected to the female terminal fitting; and wherein the second connector is a connector for a squib equipped in an inflator of a vehicle-mounted airbag system.

According to the configuration of the above-described (5), since the profile of the connector supplying electricity to the squib (heating element) of the inflator of the vehicle-mounted airbag system is lowered, it is possible to promote space-saving with respect to the inflator.

(6) There is also provided an electrical connector comprising:

a housing body;

a terminal holding portion that accommodates a terminal fitting and is inserted into a fitting portion of a counterpart connector; and a slider that slides along an insertion direction in which the terminal holding portion inserts into the fitting portion, wherein the terminal holding portion and the slider are separated by a predetermined distance and are provided on the housing body;

wherein, in a state where the terminal holding portion is not inserted into the counterpart connector, the slider is supported by a slider accommodating portion of the housing body in an inclined condition that a gap between the slider and the terminal holding portion gradually becomes narrow toward a leading edge portion of the slider; and wherein in the inclined condition of the slider, a separation distance between the leading edge portion of the slider and the terminal holding portion is smaller than a standard separation distance necessary during a regular sliding operation of the slider.

According to the configuration of (6), in the initial state that the counterpart connector is not fitted with the connector, the slider is maintained in the inclined state where the separation distance between the leading edge portion of the slider and the terminal holding portion is smaller than the standard separation distance necessary during the regular sliding operation. Therefore, even when performing positional alignment in which the leading edge portion of the slider is inclined in a direction separating from the terminal holding portion due to forming errors or the like, it is possible to keep the separation distance between the leading edge portion of the slider and the terminal holding portion in a range that does not exceed the standard separation distance necessary during a regular sliding operation.

Accordingly, if the standard separation distance necessary during the regular sliding operation is set to the outer diameter or less of the electric wire for which there is a possibility of contact with the connector during keeping or during transport, it is possible to prevent the problem in which the electric wire or the like becomes wedged in the gap between the terminal holding portion and the slider.

(7) For example, the slider includes a base portion which slidably moves inside the slider accommodating portion, a first retaining protrusion provided at a first position closest to the terminal holding portion at a periphery of the base portion, and a second retaining protrusion which is provided at a second position which is at the opposite side to the first position so that the base portion is arranged between the first position and the second position at the periphery of the base portion and is deviated in the insertion direction of the terminal holding portion from the first retaining protrusion, the slider accommodating portion has a position aligning surface which is arranged between the leading edge portion of the slider and both of the first retaining protrusion and the second retaining protrusion and which regulates movement of the slider in a protruding direction of the leading edge portion of the slider by being contacted with the first and second retaining protrusions, and in the inclined condition of the slider, only the second retaining protrusion comes into contact with the position aligning surface.

According to the configuration of (7), the inclination of the slider is set according to the deviation of the positions of the first retaining protrusion and the second retaining protrusion in the sliding direction of the slider. Therefore, with regard to the housing body, the terminal holding portion, and the slider accommodating portion, it is possible to adjust the inclination of the slider to a predetermined value and to easily realize changes in the inclination of the slider simply by changing the setting of the base portion of the slider without adding specific setting changes.

By the configuration of the present disclosure, an electrical connector which realizes retention of the terminal fitting without providing a lance at the terminal fitting and can reduce the size of the breadth of the part for accommodating the terminal fitting can be obtained.

Also, by the configuration of the present disclosure, an electrical connector capable of achieving a lowering of the profile can be obtained.

Further, by the configuration of the present disclosure, an electrical connector capable of preventing a problem in which the electric wire is wedged in the gap between the substantially cylindrical terminal holding portion protruding from the housing body and the slider during keeping or during transport or the like can be obtained.

What is claimed is:

1. An electrical connector comprising:

a first connector that accommodates a female terminal fitting connected to an end portion of an electric wire of a wire harness; and a second connector that is fitted with the first connector, wherein the first connector includes:

a housing body; and a terminal holding portion which is formed so as to be protruded from the housing body and is inserted into a fitting portion of the second connector;

wherein the second connector includes:

a holder having a male terminal to which the female terminal fitting is fitted;

a fitting portion forming member which forms the fitting portion inside the holder when the fitting portion forming member is attached to the holder so that the male terminal is passed through the holder;

a jam prevention protrusion which is integrally formed with the fitting portion forming member and extends along an insertion direction of the terminal holding portion into the fitting space to regulate inclination of the terminal holding portion during an operation of fitting the first and second connectors to each other;

wherein a leading edge portion of the jam prevention protrusion is set to a length protruding outside further than a leading edge surface of the holder;

wherein a protrusion accommodating portion is formed in the housing body which is continuous to a base end of the terminal holding portion; and wherein the protrusion accommodating portion accommodates the leading edge portion of the jam prevention protrusion so that a leading edge surface of the housing body comes into contact with the leading edge surface of the holder.

2. The electrical connector according to claim 1, wherein the first connector is a ferrite embedded connector which accommodates a ferrite core attached to an electric wire connected to the female terminal fitting; and wherein the second connector is a connector for a squib equipped in an inflator of a vehicle-mounted airbag system.

3. An electrical connector comprising:

a housing body; and a cover attached to the housing body so as to cover an opening formed in a surface of the housing body, wherein the housing body includes:

a terminal accommodating hole that accommodates a terminal fitting connected to an end portion of an electric wire; and a ferrite accommodating portion that accommodates a ferrite core attached to the electric wire;

wherein the cover covers the terminal fitting and the ferrite core attached to the housing body;

wherein the ferrite accommodating portion includes:

a ferrite accommodation chamber into which the ferrite core is inserted in a first direction perpendicular to a second direction in which the terminal fitting is inserted into the terminal accommodating hole; and protrusions provided on both inner side surfaces of the ferrite accommodation chamber facing in a third direction perpendicular to the first direction;

wherein the protrusions are engaged with concave portions formed on both side surfaces of the ferrite core to regulate movement of the ferrite core in the second direction;

wherein thickness increasing ribs extending along the first direction are provided on an inner surface of the cover and an inner lower surface of the ferrite accommodation chamber which face surfaces of the ferrite core in the second direction; and wherein rib receiving grooves for receiving the thickness increasing ribs are formed on the surfaces of the ferrite core facing the inner surface of the cover and the inner lower surface of the ferrite accommodation chamber.

4. The electrical connector according to claim 3, wherein the protrusions are ribs which extend along the first direction on the both inner side surfaces of the ferrite accommodating chamber; and wherein the concave portions are engagement grooves formed on the both side surfaces of the ferrite core so that the ferrite core is slidable along the first direction with respect to the ferrite accommodation chamber.

5. An electrical connector comprising:

a housing body;

a terminal holding portion that accommodates a terminal fitting and is inserted into a fitting portion of a counterpart connector; and a slider that slides along an insertion direction in which the terminal holding portion inserts into the fitting portion, wherein the terminal holding portion and the slider are separated by a predetermined distance and are provided on the housing body;

wherein, in a state where the terminal holding portion is not inserted into the counterpart connector, the slider is supported by a slider accommodating portion of the housing body in an inclined condition that a gap between the slider and the terminal holding portion gradually becomes narrow toward a leading edge portion of the slider; and wherein a separation distance between the leading edge portion of the slider and the terminal holding portion in the inclined condition of the slider is smaller than the separation distance between the leading edge portion of the slider and the terminal holding portion when the terminal holding portion is inserted into the fitting portion of the counterpart connector and the slider is capable of sliding along the insertion direction.

6. The connector according to claim 5, wherein the slider includes:

a base portion which slidably moves inside the slider accommodating portion;

a first retaining protrusion provided at a first position closest to the terminal holding portion at a periphery of the base portion; and a second retaining protrusion which is provided at a second position which is at the opposite side to the first position so that the base portion is arranged between the first position and the second position at the periphery of the base portion and is deviated in the insertion direction of the terminal holding portion from the first retaining protrusion;

wherein the slider accommodating portion has a position aligning surface which is arranged between the leading edge portion of the slider and both of the first retaining protrusion and the second retaining protrusion and which regulates movement of the slider in a protruding direction of the leading edge portion of the slider by being contacted with the first and second retaining protrusions; and wherein in the inclined condition of the slider, both the first retaining protrusion and the second retaining protrusion come into contact with the position aligning surface.

* * * * *